US008596498B2

(12) United States Patent
Werner et al.

(10) Patent No.: US 8,596,498 B2
(45) Date of Patent: Dec. 3, 2013

(54) MIXING AND DISPENSING DEVICE

(75) Inventors: Melanie R. Werner, Sewickley, PA (US); Paul J. Mulhauser, New York, NY (US); Karl D. Kirk, III, New York, NY (US)

(73) Assignee: Mouse Trap Design, LLC, Sewickley, PA (US)

( * ) Notice: Subject to any disclaimer, the term of this patent is extended or adjusted under 35 U.S.C. 154(b) by 0 days.

(21) Appl. No.: 13/462,461

(22) Filed: May 2, 2012

(65) Prior Publication Data

US 2012/0279990 A1 Nov. 8, 2012

Related U.S. Application Data

(60) Provisional application No. 61/481,553, filed on May 2, 2011, provisional application No. 61/560,560, filed on Nov. 16, 2011.

(51) Int. Cl.
*B67D 7/70* (2010.01)

(52) U.S. Cl.
USPC ..... 222/136; 222/132; 222/145.5; 222/144.5; 222/321.7; 222/81

(58) Field of Classification Search
USPC ..... 222/129, 130, 131, 132, 133, 135, 136, 222/144.5, 145.1, 145.5, 159, 183, 321.7, 222/325, 402.23, 80
See application file for complete search history.

(56) References Cited

U.S. PATENT DOCUMENTS 3,813,011 A 5/1974 Harrison et al.
4,006,841 A 2/1977 Alticosalian (Continued)

FOREIGN PATENT DOCUMENTS

DE 295119321 11/1996
DE 102006027778 A1 5/2008

(Continued)

OTHER PUBLICATIONS

Title: MIKS Trail Dispenser URL: http://www.interzinc.com/zinc-challenge/results.html Accessed: Dec. 19, 2012.

(Continued)

*Primary Examiner* — Paul R Durand
*Assistant Examiner* — Randall Gruby
(74) *Attorney, Agent, or Firm* — Alicia M. Passerin, Esq.; Jonathan C. Parks, Esq.; Pietragallo Gordon Alfano Bosick & Raspanti, LLP

(57) ABSTRACT

A device for dispensing a mixture of at least two fluids is disclosed. The device has a plurality of cartridges that each contain a fluid. A flow channel communicates with each cartridge. A valve adjusts a mass flow rate of the fluid drawn from the corresponding cartridge. A manifold has a mixing chamber and a plurality of inlets that each communicate with one of the flow channels. The manifold has a spring and a seal that covers the inlets. A piston is between the seal and the spring. The spring is moveable between an extended position that positions the seal to substantially and simultaneously close the inlets from the flow channels and a compressed position that positions the seal to substantially and simultaneously open the inlets to the flow channels. A dispensing pump communicates with the manifold and draws fluid from each of the cartridges. A nozzle dispenses the mixture.

23 Claims, 36 Drawing Sheets

(56) References Cited

U.S. PATENT DOCUMENTS

| | | | | |
|---|---|---|---|---|
| 4,549,674 | A | 10/1985 | Alticosalian | |
| 4,773,562 | A * | 9/1988 | Gueret | 222/135 |
| 4,826,048 | A * | 5/1989 | Skorka et al. | 222/137 |
| 4,902,281 | A * | 2/1990 | Avoy | 604/191 |
| 5,169,029 | A | 12/1992 | Behar et al. | |
| 5,332,157 | A * | 7/1994 | Proctor | 239/304 |
| 5,398,846 | A * | 3/1995 | Corba et al. | 222/1 |
| 5,634,571 | A | 6/1997 | Cataneo et al. | |
| 5,656,035 | A * | 8/1997 | Avoy | 604/191 |
| 5,848,732 | A | 12/1998 | Brugger | |
| 5,876,995 | A * | 3/1999 | Bryan | 435/189 |
| 5,897,539 | A | 4/1999 | Elliesen et al. | |
| 5,967,373 | A | 10/1999 | Seager et al. | |
| 6,003,566 | A * | 12/1999 | Thibault et al. | 141/25 |
| 6,223,788 | B1 | 5/2001 | Taylor | |
| 6,543,490 | B1 | 4/2003 | Owens | |
| 6,557,732 | B2 | 5/2003 | Van Rompuy et al. | |
| 6,719,729 | B2 | 4/2004 | Sogaro | |
| 6,793,098 | B2 * | 9/2004 | Huber et al. | 222/1 |
| 6,817,753 | B2 * | 11/2004 | Buenger et al. | 366/336 |
| 6,877,638 | B2 | 4/2005 | Chan et al. | |
| 7,044,402 | B2 * | 5/2006 | Finn | 239/302 |
| 7,124,914 | B2 * | 10/2006 | Foster et al. | 222/137 |
| 7,152,758 | B2 | 12/2006 | Fazzio et al. | |
| 7,222,802 | B2 | 5/2007 | Sweeton | |
| 7,267,248 | B2 | 9/2007 | Yerby et al. | |
| 7,377,404 | B2 | 5/2008 | Cherfane | |
| 7,481,335 | B2 | 1/2009 | Owens | |
| 7,487,888 | B1 | 2/2009 | Pierre, Jr. | |
| 7,487,889 | B2 | 2/2009 | Owens | |
| 7,533,786 | B2 * | 5/2009 | Woolfson et al. | 222/144.5 |
| 7,537,139 | B2 | 5/2009 | Jackson et al. | |
| 7,559,440 | B2 | 7/2009 | Rueschhoff et al. | |
| 7,569,028 | B2 * | 8/2009 | Stewart et al. | 604/33 |
| 7,594,594 | B2 | 9/2009 | Troost et al. | |
| 7,641,075 | B2 | 1/2010 | Crews | |
| 7,717,297 | B2 | 5/2010 | Kadyk et al. | |
| 7,775,401 | B2 | 8/2010 | Banco et al. | |
| 7,789,273 | B2 | 9/2010 | Kadyk et al. | |
| 7,789,278 | B2 | 9/2010 | Ruiz de Gopegui et al. | |
| 7,861,893 | B2 | 1/2011 | Voegele et al. | |
| 7,875,001 | B2 | 1/2011 | Minotti | |
| 7,967,220 | B2 | 6/2011 | Hansen et al. | |
| 2001/0025859 | A1 | 10/2001 | Dumont | |
| 2007/0012725 | A1 | 1/2007 | Jajeh | |
| 2007/0080170 | A1 * | 4/2007 | Saha | 222/142.1 |
| 2008/0110930 | A1 * | 5/2008 | Wittkamp et al. | 222/135 |
| 2008/0203110 | A1 | 8/2008 | LaFlamme et al. | |
| 2009/0005903 | A1 | 1/2009 | Winsness | |
| 2009/0108021 | A1 * | 4/2009 | Hansen et al. | 222/1 |
| 2009/0152298 | A1 * | 6/2009 | Woolfson et al. | 222/144.5 |
| 2010/0133293 | A1 | 6/2010 | Ziesel | |
| 2010/0185322 | A1 | 7/2010 | Bylsma et al. | |
| 2010/0252574 | A1 | 10/2010 | Busin | |
| 2010/0264162 | A1 | 10/2010 | Cratensburg et al. | |
| 2011/0011888 | A2 | 1/2011 | Bevis et al. | |
| 2011/0079610 | A1 | 4/2011 | Kadyk et al. | |
| 2011/0121034 | A1 | 5/2011 | Swab et al. | |
| 2011/0139180 | A1 | 6/2011 | Williams et al. | |
| 2011/0204090 | A1 | 8/2011 | Worthington et al. | |
| 2011/0215113 | A1 | 9/2011 | Hansen et al. | |
| 2011/0259919 | A1 | 10/2011 | Choiniere et al. | |
| 2011/0284579 | A1 * | 11/2011 | Pardes et al. | 222/71 |
| 2011/0303694 | A1 | 12/2011 | Pié | |

FOREIGN PATENT DOCUMENTS

| | | | |
|---|---|---|---|
| EP | 0676339 | A2 | 10/1995 |
| FR | 1408299 | A | 8/1965 |
| WO | 2008/053311 | A2 | 5/2008 |

OTHER PUBLICATIONS

Title: Dual-chambered dispenser URL: http://www.packworld.com/applications/personal-care/dual-chambered-dispenser Accessed: Jun. 28, 2012.

Tile: Variblend URL: http://www.variblend.com Accessed: Dec. 19, 2012.

Title: Dual-chamber Yonwoo dispenser for Biotherm Age Fitness Elastic URL: http://www.quadpack.net/uk/our-products/latest-launches/dual-chamber-yonwoo-dispenser-for-biotherm-age-fitness-elastic/ Accessed: Jun. 28, 2012.

Title: Two-in-One bottle for olive oil and vinegar URL: http://bestinpackaging.com/2011/05/05/dual-chamber-bottles/ Accessed: Dec. 19, 2012.

* cited by examiner

MIXING AND DISPENSING DEVICE

CROSS REFERENCE TO RELATED APPLICATIONS

This application claims priority to U.S. Provisional Application No. 61/481,553, filed May 2, 2011, and U.S. Provisional Application No. 61/560,560, filed Nov. 16, 2011, both of which are incorporated herein by reference.

BACKGROUND

Various devices are known in the art to dispense fluids. Typically, dispensers hold a single fluid, however, it is often desirable for multiple fluids to be stored in separate storage containers within a single device, and then mixed and immediately dispensed as a mixture from the device. In various industries, including the fragrance industry, it is desirable to have a device that is configured to proportionally adjust the volumetric ratio of each fluid that comprises the mixture, in order to provide a customized fragrance or product that includes each of a plurality of fluids.

SUMMARY

In an embodiment, a device for mixing a plurality of fluids to formulate a mixture and for dispensing the mixture is disclosed. The device comprises a plurality of cartridge assemblies each comprising a cartridge configured to contain one of the plurality of fluids. There is a plurality of flow channels each having a central axis and each configured to communicate with a corresponding one of the cartridges. A plurality of valve assemblies is each positioned to communicate with one of the flow channels to adjust a mass flow rate of the fluid drawn from the corresponding cartridge. There is a manifold assembly positioned downstream to the valve assembly. The manifold assembly comprises a manifold body having a mixing chamber and a plurality of inlets each configured to communicate with a corresponding one of the flow channels through which the fluid from the cartridge of the corresponding cartridge assembly is drawn into the mixing chamber during operation of the device. The manifold assembly also has a seal disposed within the manifold body adjacent to and having a size and a shape that substantially covers the inlets. The manifold assembly has a spring disposed within the manifold body and a piston disposed within the manifold body between the seal and the spring. The spring is moveable between an extended position in which the spring engages the piston to move the seal to a closed position that substantially and simultaneously closes the inlets from the flow channels and a compressed position that moves the seal away from the inlets to substantially and simultaneously open the inlets to the flow channels. The device also has a dispensing pump assembly configured to communicate with the manifold assembly and configured to draw fluid from each of the cartridge assemblies. A nozzle is configured to communicate with the dispensing pump assembly and to dispense the mixture. During operation the dispensing pump draws a volume of fluid from each cartridge through the corresponding flow channel and through the corresponding inlet into the mixing chamber to form the mixture. The mixture is drawn from the mixing chamber through the dispensing pump to the nozzle.

In another embodiment, a device for mixing a plurality of fluids to form a mixture and for dispensing the mixture is disclosed. The device has a plurality of cartridges each configured to contain one of the plurality of fluids. A plurality of flow channels each have a central axis and are each configured to communicate with a corresponding one of the cartridges. A plurality of independently adjustable valves are each positioned adjacent to one of the flow channels and are each adjustable along a second axis that is not parallel to the central axis to adjust a mass flow rate of the fluid drawn from the corresponding cartridge. A manifold body has a plurality of inlets each configured to communicate with a corresponding one of the flow channels through which the fluid from the corresponding cartridge is drawn into a mixing chamber during operation. A seal is disposed within the manifold body adjacent to and sized to substantially cover the inlets. A piston is disposed within the manifold body between the seal and a spring, wherein the spring is moveable between an extended position in which the spring engages the piston to move the seal to a closed position that substantially and simultaneously closes the inlets from the flow channels and a compressed position that moves the seal away from the inlets to substantially and simultaneously open the inlets to the flow channels. A dispensing pump is configured for communication with the mixing chamber and is configured to draw fluid from each of the cartridges. A nozzle is configured for communication with the dispensing pump and is configured to dispense the mixture. During operation the dispensing pump draws a volume of fluid from each cartridge through the corresponding flow channel and through the corresponding inlet into the mixing chamber to form the mixture. The mixture is drawn from the mixing chamber through the dispensing pump to the nozzle.

In another embodiment, a device for mixing a plurality of fluids to form a mixture and for dispensing the mixture is disclosed. There is a plurality of cartridge assemblies, each cartridge assembly comprising cartridge configured to contain one of the plurality of fluids and a plurality of flow channels. Each flow channel has a lumen having a cross-sectional area, a central axis, and is configured to communicate with a corresponding one of the cartridges, wherein the cross-sectional area of each flow channel is directly proportional to a mass flow rate of fluid drawn from the corresponding cartridge during operation of the device. The device has a manifold assembly that has a manifold body having a mixing chamber and a plurality of inlets each configured to communicate with a corresponding flow channel through which the fluid from the cartridge of the corresponding cartridge assembly is drawn into the mixing chamber during operation. A seal is disposed within the manifold body adjacent to and sized to substantially and simultaneously close the inlets. A spring is disposed within the manifold body. A piston is disposed within the manifold body between the seal and the spring. The spring is moveable between an extended position in which the spring engages the piston to move the seal to a closed position that substantially and simultaneously closes the inlets from the flow channels and a compressed position that moves the seal away from the inlets to substantially and simultaneously open the inlets to the flow channels. A dispensing pump assembly is configured for communication with the manifold assembly and is configured to draw fluid from each of the cartridge assemblies. A nozzle is configured for communication with the dispensing pump assembly and is configured to dispense the mixture. During operation the dispensing pump draws the volume of fluid from each cartridge assembly through the corresponding inlet into the mixing chamber to form the mixture. The mixture is drawn from the mixing chamber through the dispensing pump to the nozzle.

Other objects, features, aspects and advantages of the mixing and dispensing device will become better understood or apparent from the following detailed description, drawings, and appended claims.

DETAILED DESCRIPTION

Figure 1A:
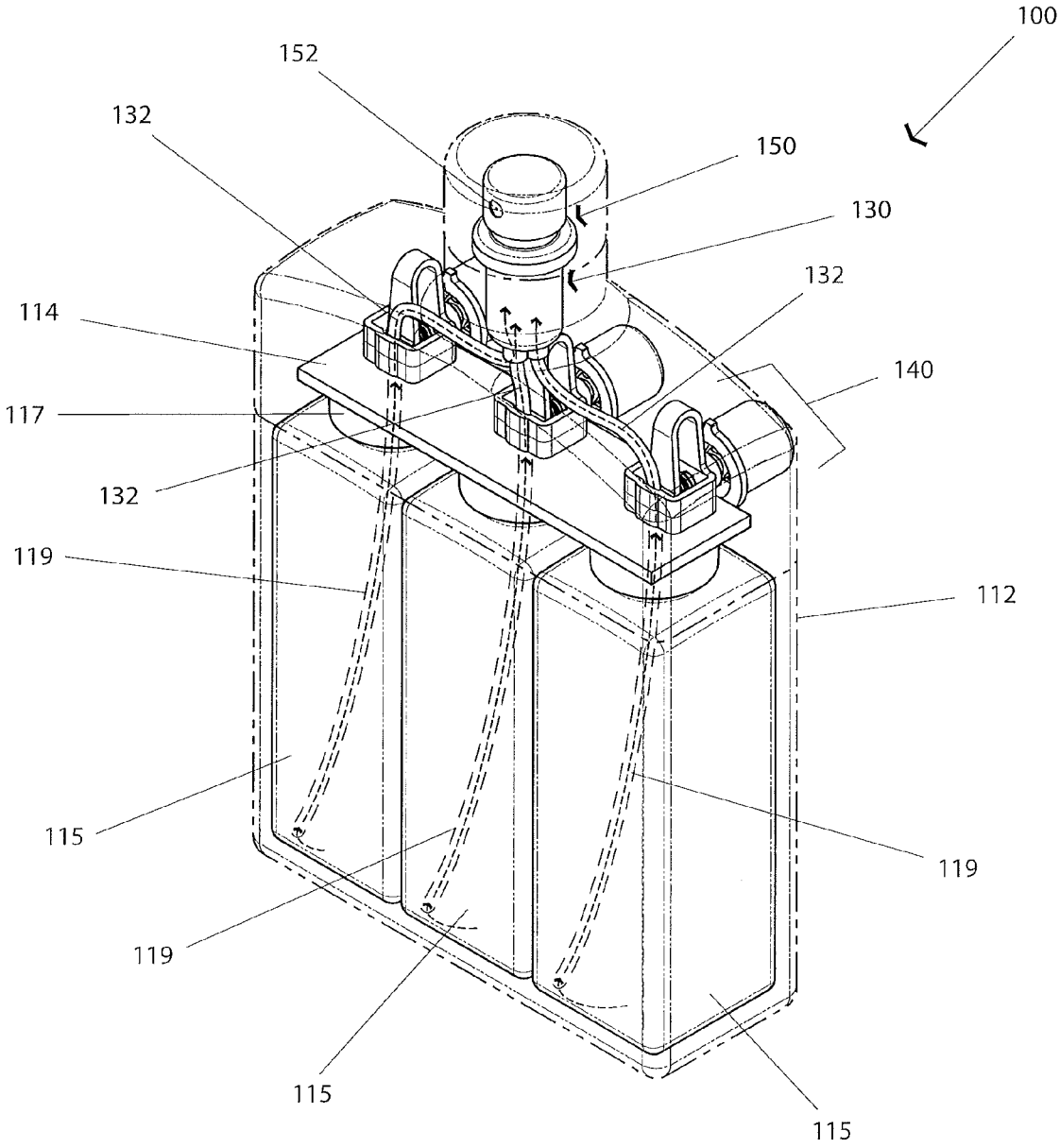
FIG. 1 is an embodiment of a mixing and dispensing device illustrating a cartridge and valve assemblies in a linear array, showing (A) a front isometric view and including dashed arrows that illustrate the flow of fluid through the device when the device is in operation, (B) a rear isometric view, (C) a side elevation view, (D) an exploded view, (E) an exploded detail view of a valve, (F) an isometric detail view of a cartridge, (G) a cross-sectional view of a cartridge, (H) an exploded view of a cartridge, and (I) a cross-sectional view of a cartridge having a bladder positioned therein.
Figure 1B:
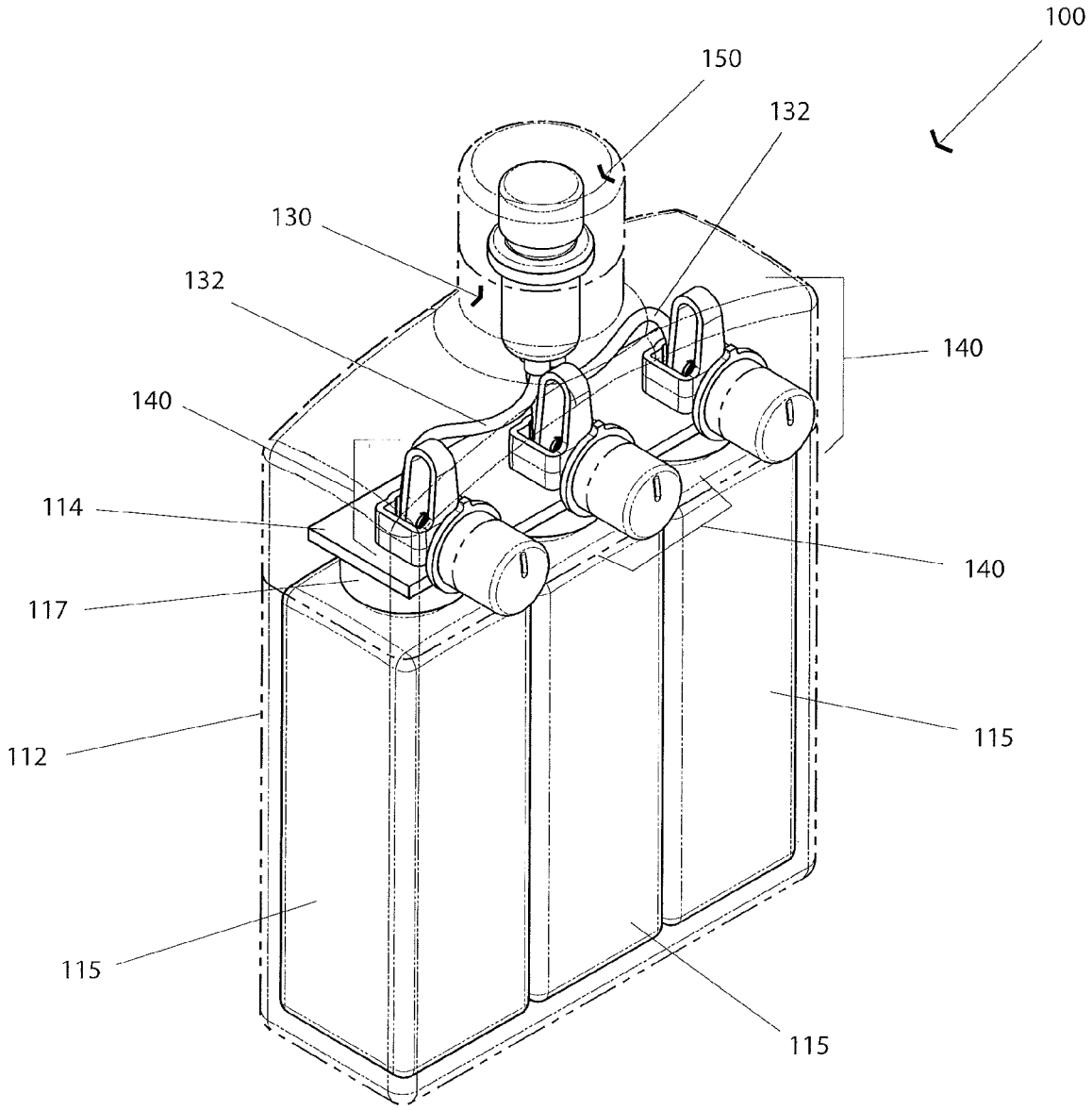
Figure 1C:
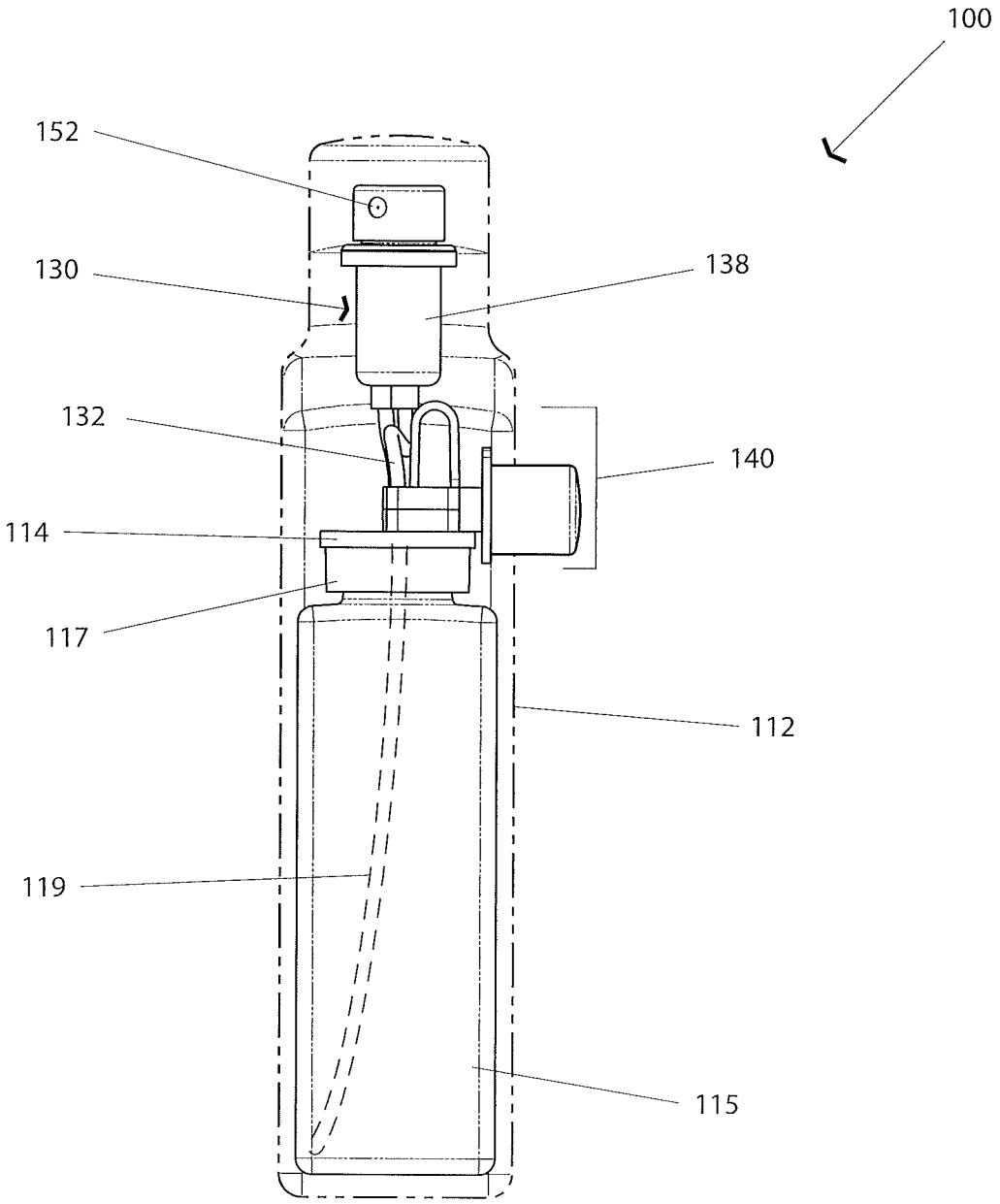

As shown generally in the Figures, embodiments of a device 100, 200, 300, 400, 1200 for mixing a plurality of fluids to formulate a mixture and dispensing the mixture are disclosed. As shown in FIGS. 1 to 4 and 12, the device 100, 200, 300, 400, 1200 has at least two cartridge assemblies 120, 220, 320, 420, 1220 positioned relative to each other in a linear (FIGS. 1, 3, 4), radial (FIG. 2), or non-linear (FIG. 12) array. Each cartridge assembly 120, 220, 320, 420, 1220 has a cartridge 115, 215, 315, 415, 1215 that is configured to hold a fluid. In various embodiments, the fluid in each cartridge 115, 215, 315, 415, 1215 is a fragrance oil, a solvent, a pigment, an ink, a dye, a medication, a dietary supplement, a flavoring, spirits, a cleaning substance, or any other such substance available in a liquid form. The device 100, 200, 300, 400, 1200 has at least two flow channels 132, 232, 332, 432, 1232 each associated with a corresponding cartridge 115, 215, 315, 415, 1215. Embodiments (FIGS. 1-3, 12) have adjustable valve assemblies 140, 240, 340, 1240 configured to adjust a mass flow rate of fluid from each cartridge 115, 215, 315, 1215. The flow channels 132, 232, 332, 1232 are configured to communicate with a manifold assembly 130, 230, 330, 1230. In the embodiments illustrated in FIGS. 1-3 and 12, the manifold assembly 130, 230, 330, 1230 is positioned downstream from the adjustable valve assemblies 140, 240, 340, 1240. Referring again generally to the Figures, a dispensing pump assembly 150, 250, 350, 450, 1250 is positioned downstream from the manifold assembly 130, 230, 330, 430, 1230 and is configured to communicate with a nozzle 152, 252, 352, 452, 1252 that is positioned downstream from the dispensing pump 150, 250, 350, 450, 1250. In the embodiments illustrated in FIGS. 1-3 and 12, the fluid communication between each cartridge 115, 215, 315, 1215, its corresponding flow channel 132, 232, 332, 1232, and the manifold assembly 130, 230, 330, 1230 is adjustable by the corresponding valve assembly 140, 240, 340, 1240. Referring again to FIGS. 1-4 and 12, the manifold assembly 130, 230, 330, 430, 1230, dispensing pump assembly 150, 250, 350, 450, 1250 and nozzle 152, 252, 352, 452, 1252 are in fluid communication with each other when the dispensing pump assembly 150, 250, 350, 450, 1250 is actuated.

During operation, the device 100, 200, 300, 400, 1200 is configured to formulate a mixture of a plurality of fluids in the manifold assembly 130, 230, 330, 430, 1230 where each fluid is drawn through a corresponding flow channel 132, 323, 332, 432, 1232 to a mixing chamber 137, 237, 337, 437, 1237 disposed within the body 138, 238, 338, 438, 1238 of the manifold assembly at a mass flow rate that may be proportional to a preset volumetric ratio. The mixture of the plurality of fluids is drawn into the dispensing pump assembly 150, 250, 350, 450, 1250 from which it is subsequently expelled through the nozzle 152, 252, 352, 452, 1252. In embodiments of the device 100, 200, 300, 1200 such as those illustrate in FIGS. 1-3 and 12, the volumetric ratio of each fluid comprising the mixture is adjusted by an adjustable valve 140, 240, 340, 1240 that independently adjusts the mass flow rate of each one of the fluids that is drawn from each cartridge through the corresponding flow channel during operation of the device. In another embodiment of the device 400 illustrated in FIG. 4, the volumetric ratio of each fluid comprising the mixture is directly proportional to the cross-sectional area of a lumen of each flow channel 432, which determines the mass flow rate of the fluid therethrough during operation of the device 400. Referring generally to the Figures, the result of operation of the device 100, 200, 300, 400, 1200 is the expulsion of a customized mixture from the nozzle 152, 252, 352, 452, 1252.

Figure 1D:
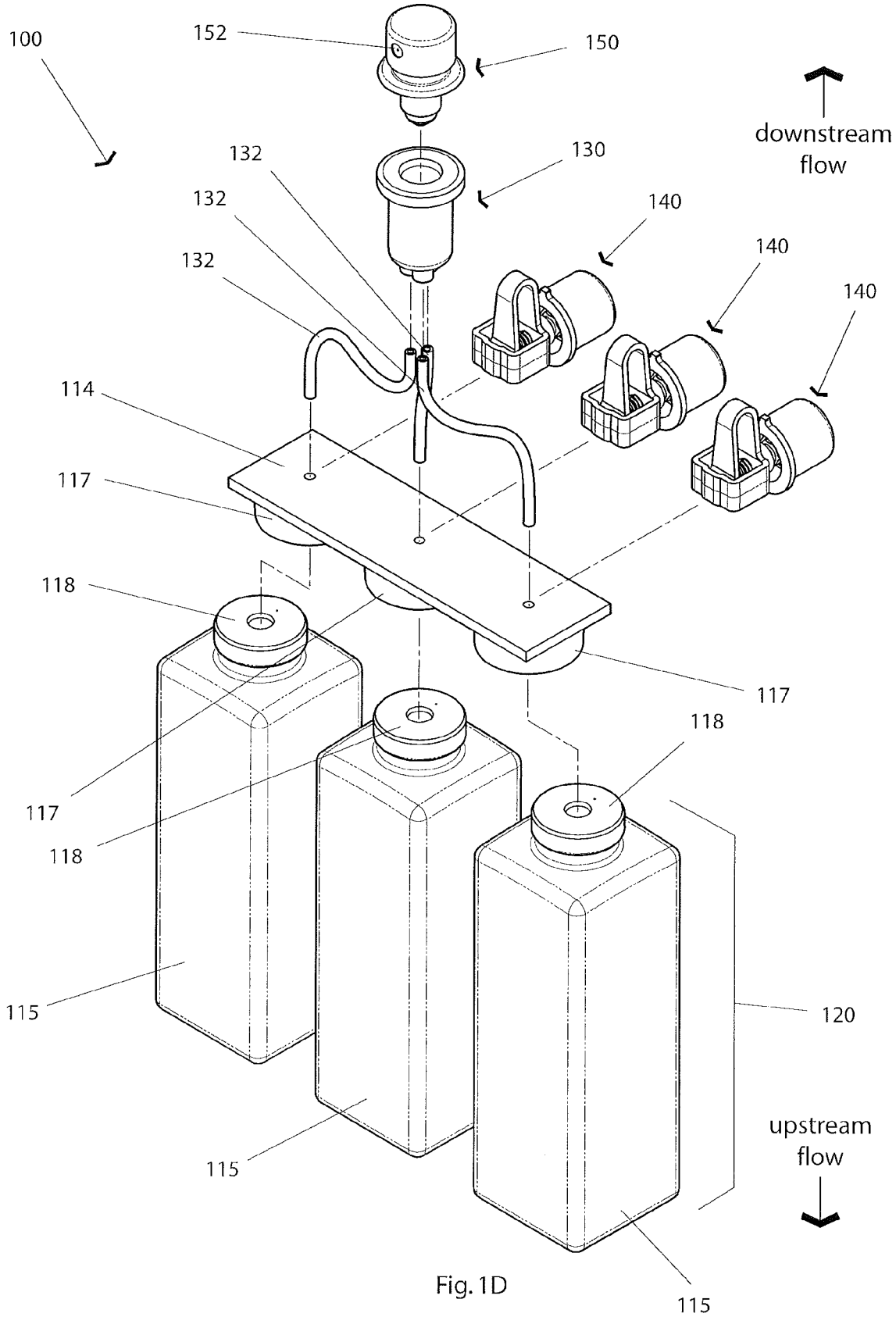
Figure 1E:
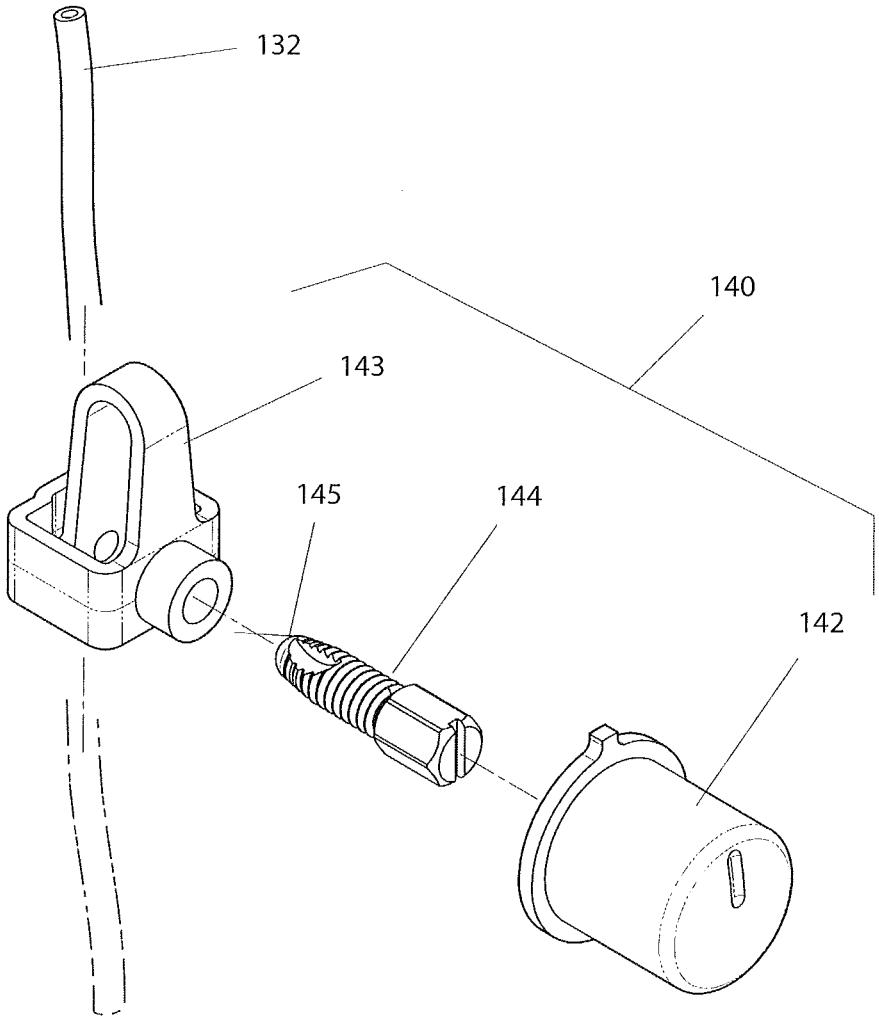
Figure 1F:
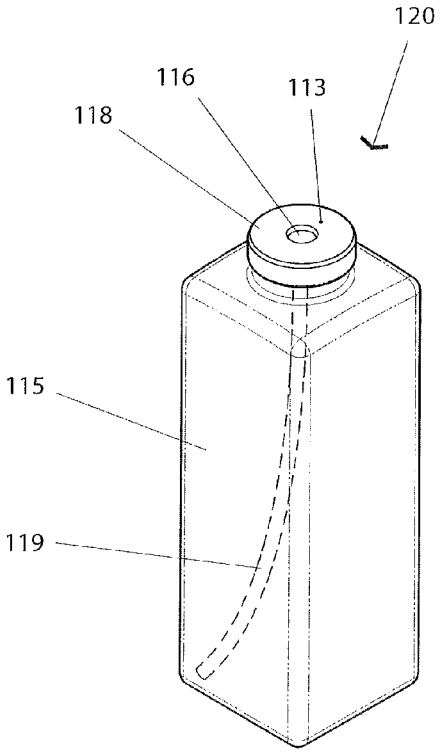
Figure 1G:
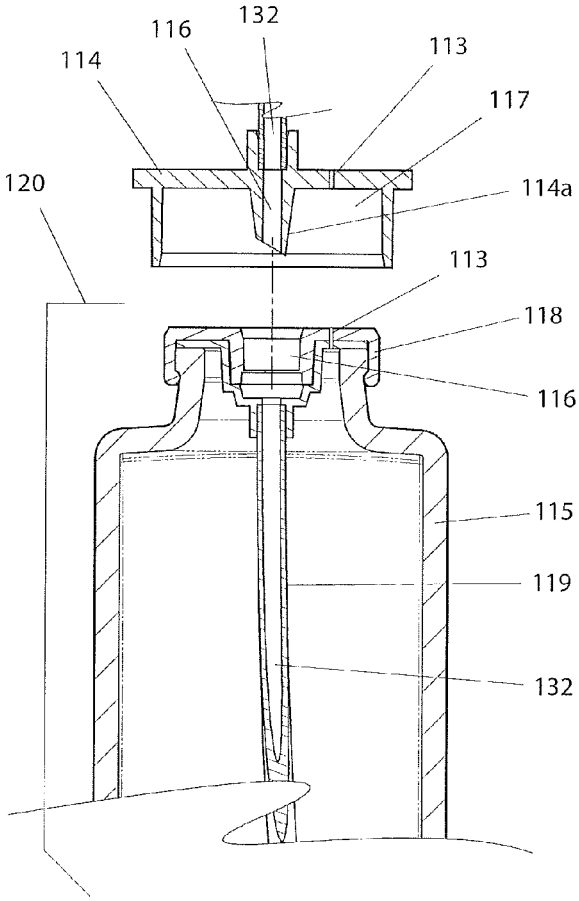
Figure 1H:
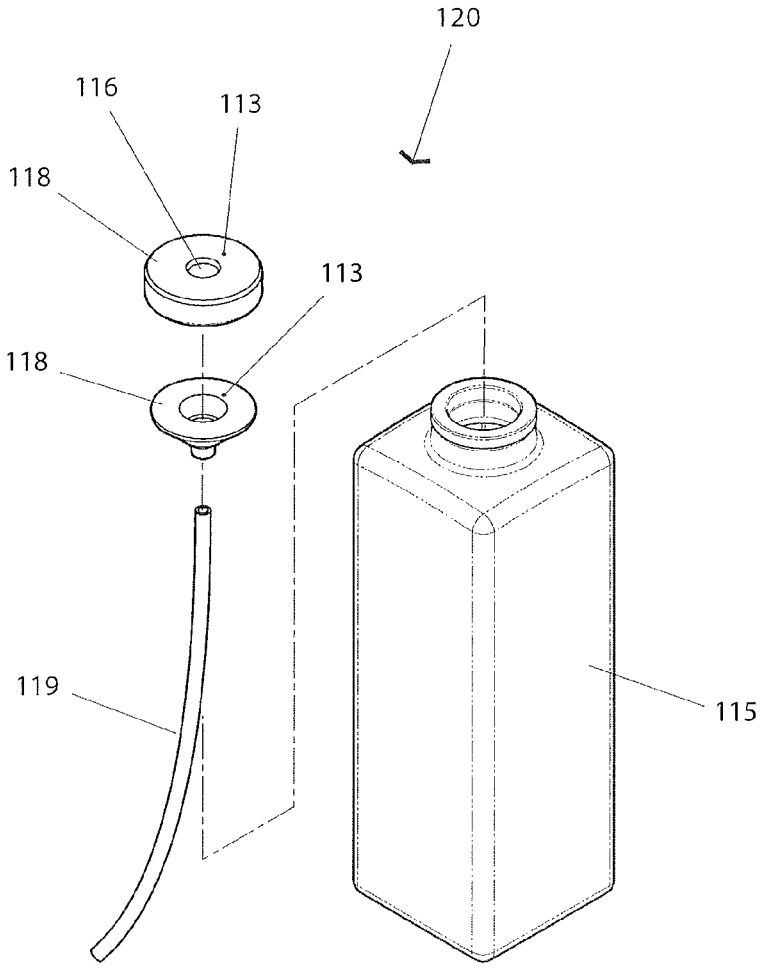
Figure 1I:
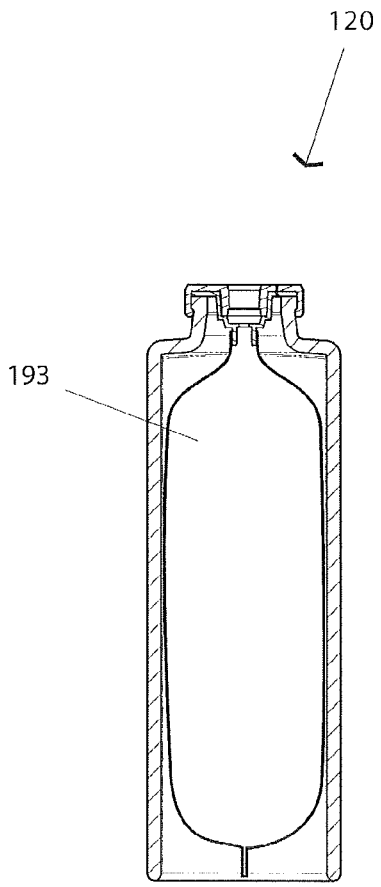
Figure 2A:
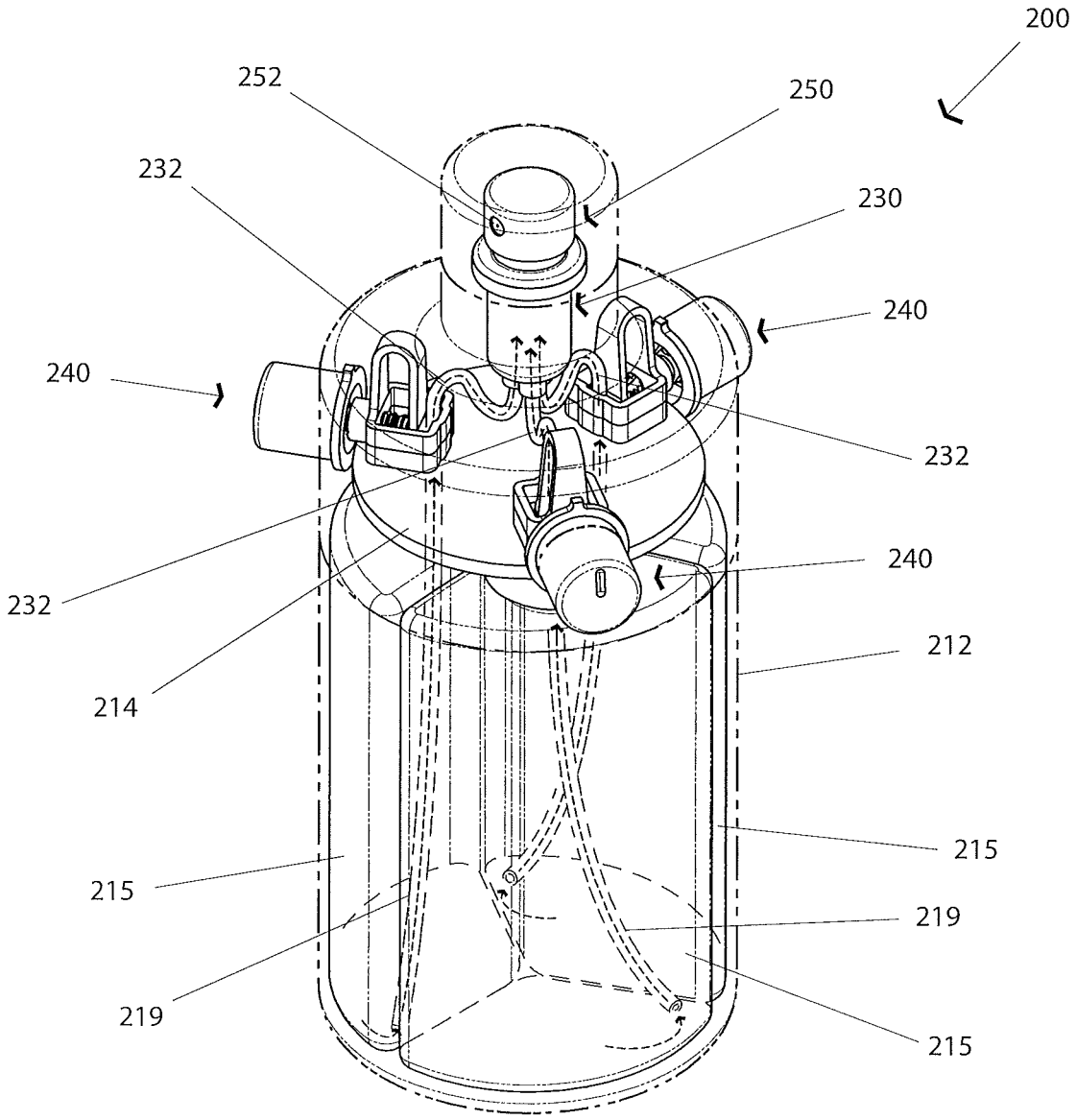
FIG. 2 is another embodiment of the mixing and dispensing device illustrating the cartridge and valve assemblies in a radial array, showing (A) a front isometric view and including dashed arrows that illustrate the flow of fluid through the device when the device is in operation, (B) a rear isometric view, and (C) a side elevation view.
Figure 2B:
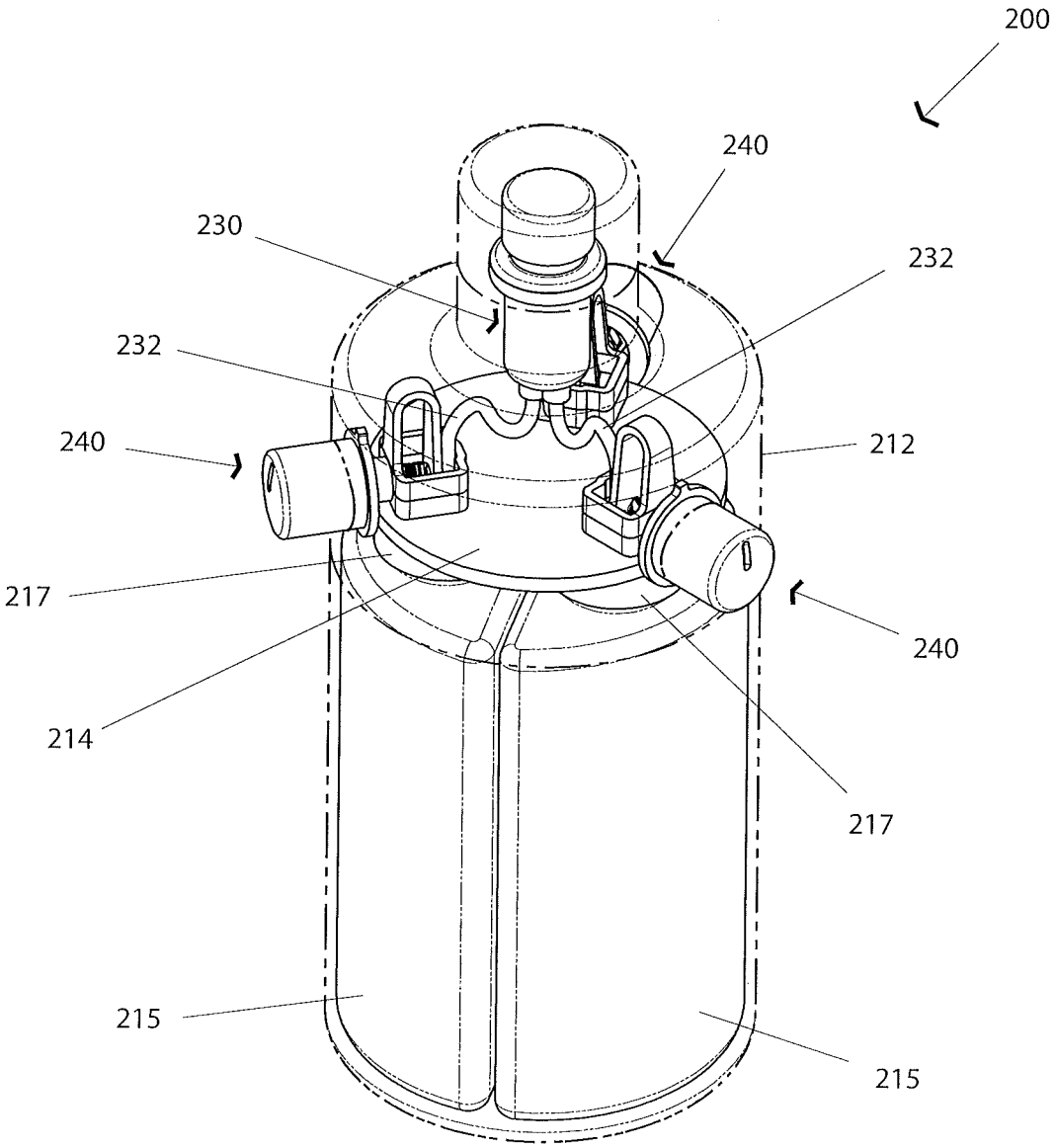
Figure 2C:
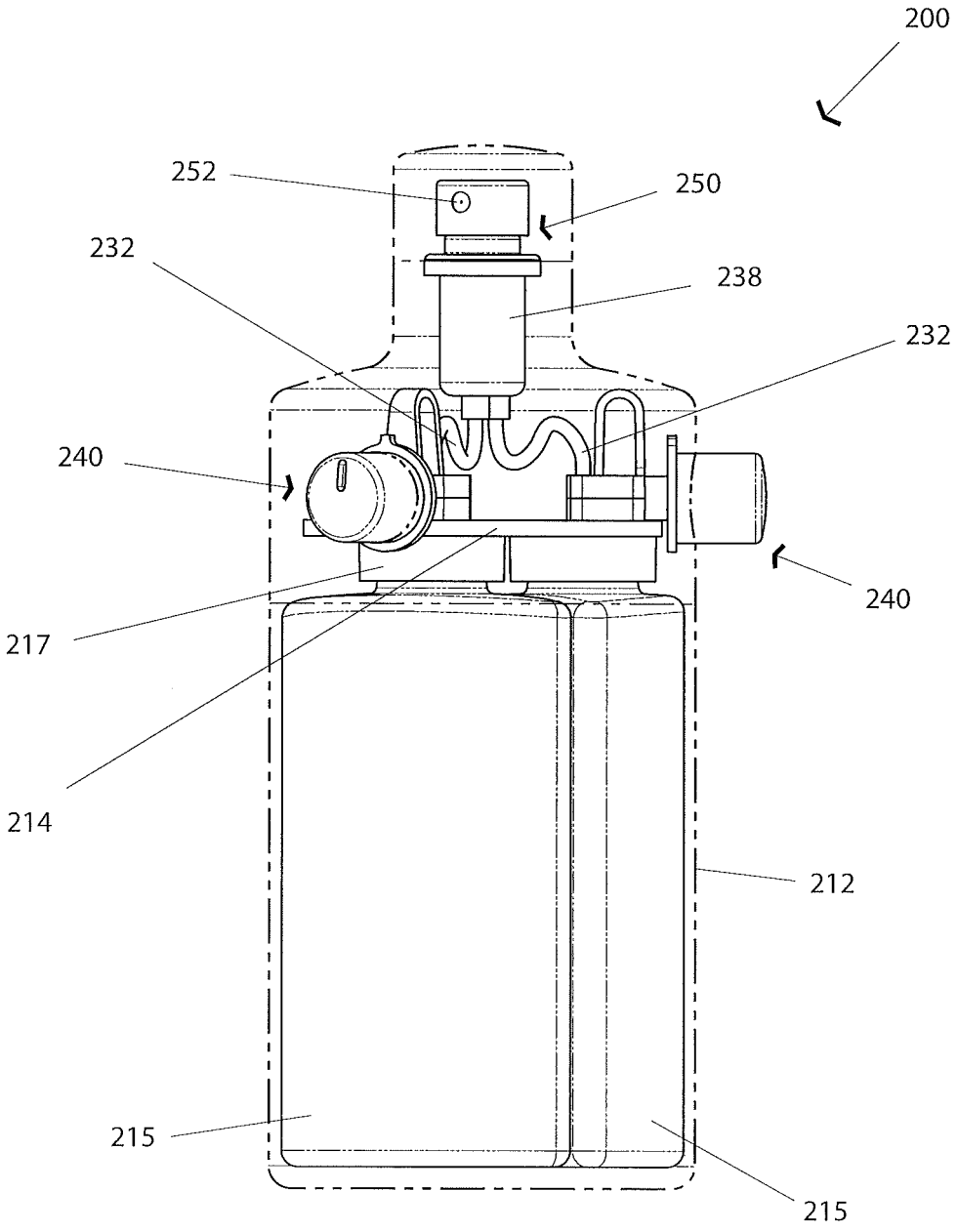

When referring to the embodiments illustrated in FIG. 1, the device is designated as 100 with the corresponding reference numbers for component parts indicated in the 100 series, while the embodiment illustrated in FIG. 2 is designated as device 200 with the corresponding reference numbers for component parts indicated in the 200 series. For example, the cartridge assembly of device 100 is designated 120 while the cartridge assembly of device 200 is designated 220. Devices 100, 200 are described together in the following description because the devices 100, 200 differ only in the configuration of the cartridge assemblies 120, 220 relative to each other and the resulting configuration of inlets 139, 239.

In embodiments of the device 100, 200 illustrated in FIGS. 1, 2, respectively, the device 100, 200 has at least two cartridge assemblies 120, 220 each comprising a cartridge 115, 215. At least two flow channels 132, 232 are each configured to communicate with an interior of a corresponding one of the cartridges 115, 215. The device 100, 200 has at least two adjustable valve assemblies 140, 240 each positioned to communicate with a corresponding one of the flow channels 132, 232 to adjust a mass flow rate of fluid that is drawn by the dispensing pump assembly 150, 250 from the corresponding cartridge 115, 215 through the flow channel 132, 232 each time the dispensing pump assembly 150, 250 rebounds to its resting state. By way of example, positioned to communicate includes positioned adjacent to the corresponding flow channel 132, 232 (e.g., FIGS. 8-10) or positioned within the lumen of the corresponding flow channel 132, 232 (e.g., FIG. 11). Referring again to FIGS. 1, 2, the device 100, 200 has a manifold assembly 130, 230 positioned downstream from the adjustable valve assembly 140, 240 and a dispensing pump assembly 150, 250 positioned downstream from the manifold assembly 140, 240. The dispensing pump assembly 150, 250 is configured to communicate with a downstream nozzle 152, 252.

Optionally, the cartridge assemblies 120, 220, flow channels 132, 232, adjustable valve assemblies 140, 240 (except for the moveable control), manifold assembly 130, 230, and dispensing pump assembly 150, 250 are enclosed in a body 112, 212. In embodiments, the body 112, 212 is comprised of a single component or multiple components. In an embodiment, a portion of the body 112, 212 is removable or is configured to open or close to provide or restrict access, respectively, to the cartridges, for example, as useful to remove and replace a cartridge. Body 112, 212 may be made of plastic, such as injection molded polycarbonates, polystyrenes, etc.

As illustrated in FIG. 1D, each cartridge assembly 120 includes a cartridge 115 and a cartridge receptacle 117 configured to receive a neck of cartridge 115. In an example, the neck and the cartridge receptacle 117 are configured to threadably engage. In another example, the cartridge 115 is snap-fit into the cartridge receptacle 117. Optionally, the cartridge assembly 120 includes a spike plate 114. The spike plate 114 is configured to communicate with the interior of a corresponding cartridge 115 such as for example by a port 114*a* in the spike plate 114 or by a coupling (not shown) attached to or integral with the spike plate 114 that has a distal end that pierces the closure device (described below) of the cartridge and a proximal end that communicates with the corresponding flow channel 132. Cartridge assembly 220 is the same as described herein with respect to cartridge assembly 120 in connection with FIG. 1D. One skilled in the art will appreciate that spike plate 114, port 114*a*, and cartridge receptacle 117 may be unitary components, such as an integrally injection molded part, or assembled parts.

Referring again generally to FIGS. 1 and 2, in an embodiment, each cartridge 115, 215 is removable and replaceable. In another embodiment, each cartridge 115, 215 is permanently affixed onto or within the body 112. The cartridges 115, 215 may be of differing or the same volume capacity, length, or diameter. In embodiments, the cartridges 115, 215 are made from, by way of example, glass, plastic, metallic materials, collapsible or pliable materials such as a bladder, or materials that are resistant to degradation by the fluids contained or to be contained therein. In an embodiment, the cartridges 115, 215 are clear to render the fluid contents visible. Optionally, a window (not shown) is positioned in a wall of an opaque cartridge to show the fluid contents thereof.

As illustrated in FIGS. 1, 2, and particularly in FIG. 1D, each cartridge 115, 215 has a closure device 118, 218, such as a cap, seal, or the like that substantially closes the cartridge 115, 215 so that the fluid contained therein does not leak out. The closure device 118, 218 is either integral with the cartridge 115, 215 or assembled. A port 116, 216, optionally positioned in or integral with the closure device 118, 218, provides communication between the interior of cartridge 115, 215 and the corresponding flow channel 132, 232 when the port 116, 216 is in the opened position. Port 116, 216 is in the closed position when the cartridge 115, 215 is disconnected from the cartridge assembly 120, 220. As illustrated in FIG. 1D, the port 116 is configured to receive a distal end of the corresponding flow channel 132 or a coupling (not shown), such as a spike, needle, nipple, zirk, or other such connector, that connects or couples the distal end of the corresponding flow channel 132 to the interior of the cartridge 115. In an embodiment, the port 116 is a pierceable septum.

Each cartridge 115, 215 has a vent 113 (see FIGS. 1D, 1F, 1G, 1H) that is configured for entry of atmospheric air into the cartridge 115, 215 as fluid is removed by the dispensing pump 150, 250. The vent 113 substantially eliminates the buildup of vacuum in the cartridge 115, 215. The vent 113 is configured to substantially prevent leakage of the fluid from the cartridge 115, 215. Optionally, the vent 113 is positioned within or is integral with the closure device 118, 218 or the port 116, 216. By way of example, the vent 113 is an elastomeric duck-bill valve, a flapper valve, an umbrella valve, a diaphragm, etc. In another example, the vent 113 is a spring-loaded assembly such as a ball or ball plunger that engages a sealing aperture.

Optionally, as illustrated in FIG. 1I, a bladder 193 is positioned in the interior of the cartridge 115 and is configured to hold the fluid. The port 116 is in communication with the interior of the bladder 193. In embodiments, the bladder 193 is at least one of flexible, removable, replaceable, and refillable.

Optionally, as illustrated in FIG. 1D, a conduit 119, such as a sipper tube, is included in each cartridge 115. The conduit 119 is configured to draw fluid from the interior of the cartridge 115 and to communicate with the distal end of the corresponding flow channel 132. As illustrated in FIGS. 1 and 2, a flow channel 132, 232 is in communication with the interior of a corresponding cartridge 115, 215 either directly or via connection to coupling (not shown). Each flow channel 132, 232 transports the fluid from the corresponding cartridge 115, 215 to the mixing chamber 137, 237 of the manifold 130, 230 when the dispensing pump assembly 150, 250 is rebounding. Each flow channel 132, 232 has proximal and distal ends, a central axis, and a lumen that has a cross section. In an embodiment, the port 116, 216 of the cartridge 115, 215 receives a distal end of the corresponding flow channel 132, 232. In another embodiment, the port 116, 216 receives a distal end of coupling that is connected to the distal end of the corresponding flow channel 132, 232.

As shown in FIGS. 1, 2, and 5-11, the proximal end of each flow channel 132, 232 is in communication with one of the inlets 139, 239 of the manifold 130, 230. In an embodiment, the flow channel 132, 232 is compressible or pliable, such as an elastomeric material made of, for examples, extruded PVC, silicone, etc. In another embodiment, the flow channel 132, 232 is made of a semi-rigid or rigid material.

Figure 9A:
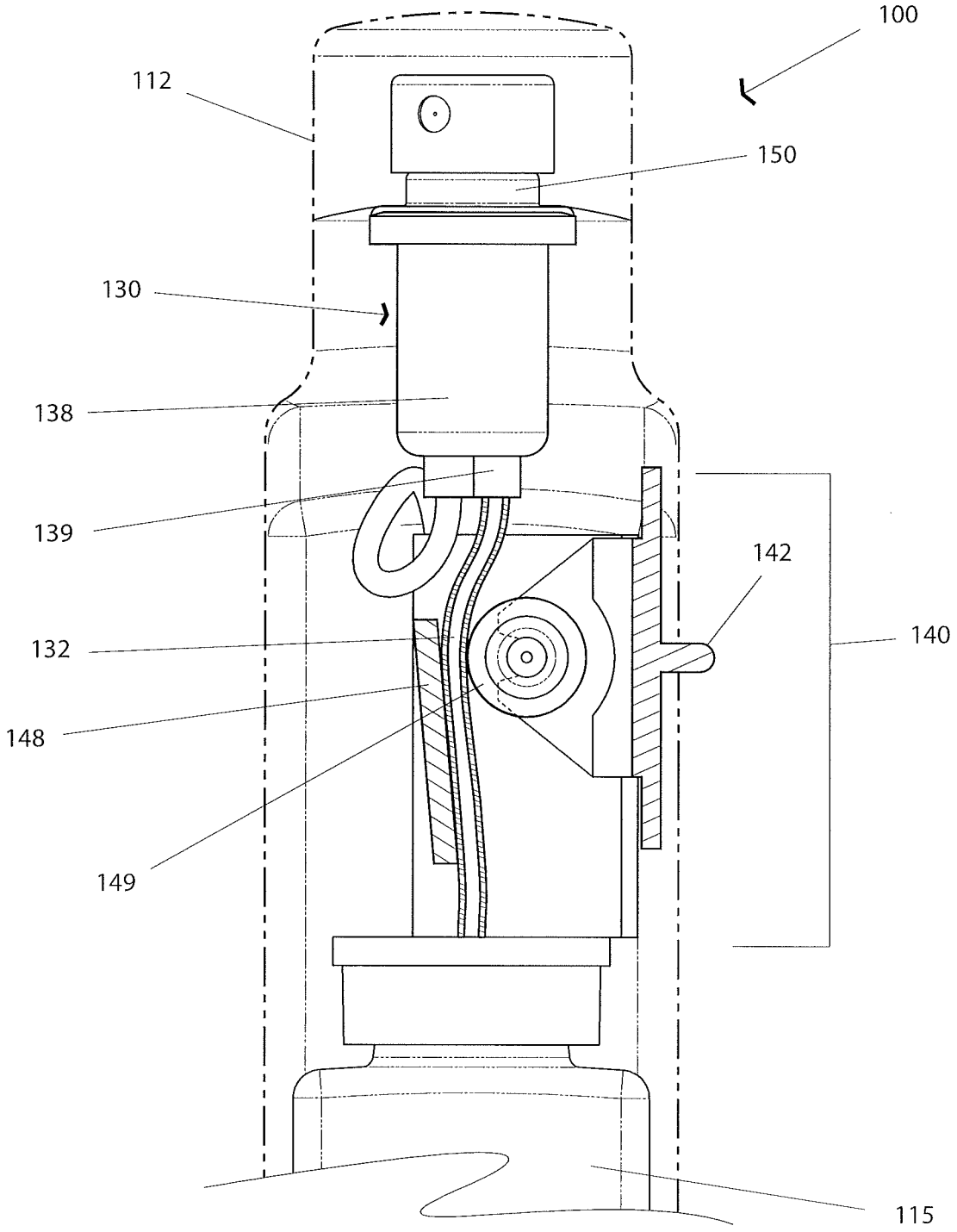
FIG. 9 is a partial cross-sectional view of an embodiment of a mixing and dispensing device taken through the valve assembly and showing a slider-actuated pinch valve in (A) the fully opened position and (B) the fully closed position.
Figure 9B:
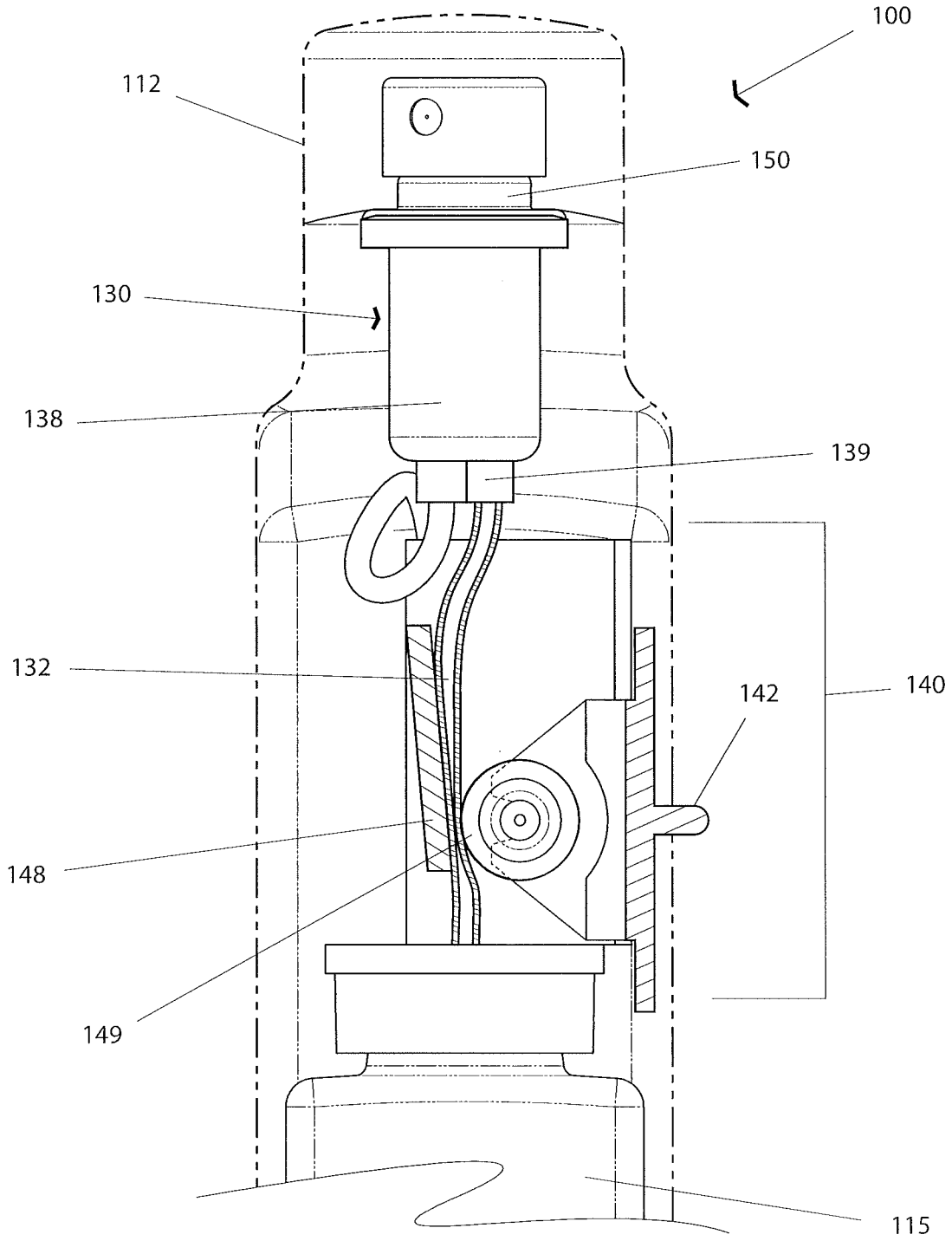
Figure 10A:
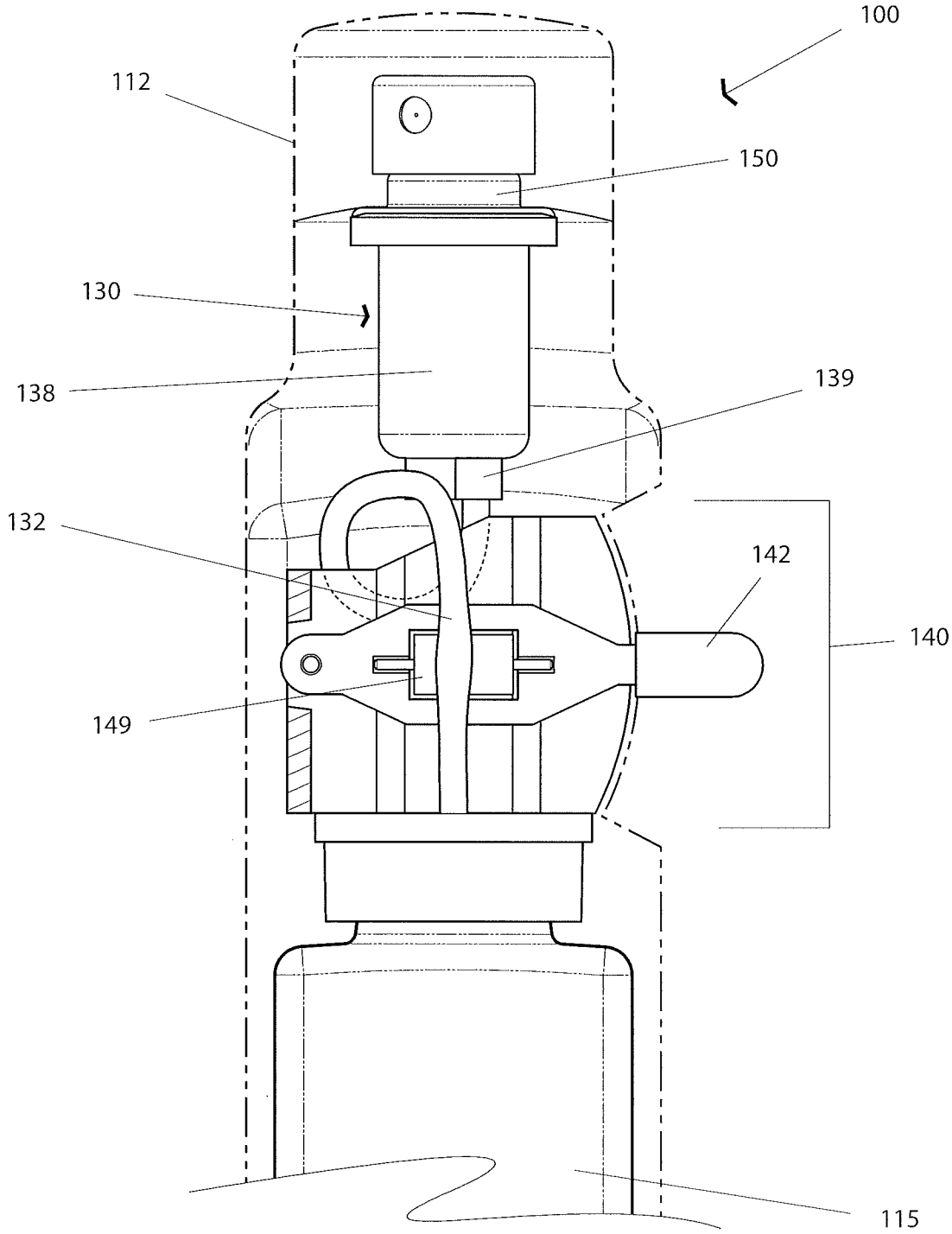
FIG. 10 is (A) a partial cross-sectional view of an embodiment of a mixing and dispensing device taken through the valve assembly and showing a lever-arm actuated pinch valve in a partially opened position, (B) a partial cross-sectional side view detail through the lever-arm actuated pinch valve in a partially opened position, and (C) a rear view detail cross-sectional view through a lever-arm actuated pinch valve in a partially opened position.
Figure 10B:
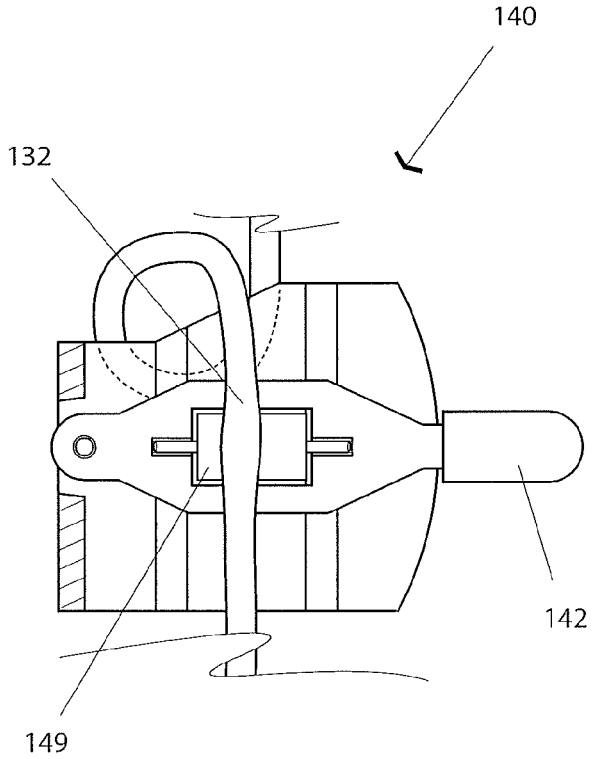
Figure 10C:
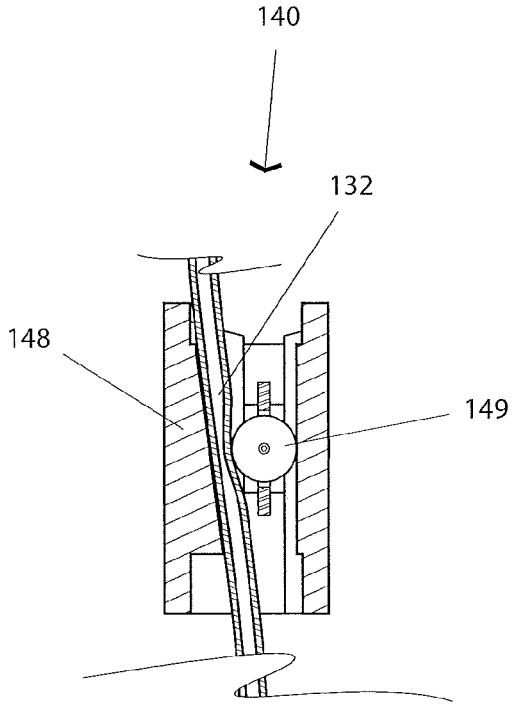

As illustrated in FIGS. 1, 2, and 8-11, in an embodiment, an adjustable valve assembly 140, 240 is positioned to communicate with a corresponding flow channel 132, 232. Each adjustable valve assembly 140, 240 may be controlled independently from other adjustable valve assemblies 140, 240 in the device 100, 200. Each adjustable valve assembly 140, 240 may function independently from other adjustable valve assemblies in the device. The adjustable valve assembly 140, 240 adjusts a mass flow rate of fluid that is drawn by the dispensing pump assembly 150, 250 from the corresponding cartridge 115, 215 through the flow channel 132, 232 each time the dispensing pump assembly 150, 250 rebounds. Each adjustable valve assembly 140, 240 has a moveable control 142, 242 that is configured for use by a user to adjust the adjustable valve assembly 140, 240 to a position that adjusts the mass flow rate of fluid from a corresponding cartridge 115, 215 through the adjacent flow channel 132, 232 when the device 100, 200 is in operation. The moveable control 142, 242 is, for examples, a rotary knob or screw (FIGS. 1, 2, 8), a slider switch (FIG. 9), or a lever arm (FIG. 10). This list is not intended to be inclusive however, and the moveable control 142, 242 can be anything known by those skilled in the art to be functional in the device. Optionally, the moveable control 142, 242 has a scale or other indicator (not shown) that indicates the position of one adjustable valve assembly 140, 240 relative to the other adjustable valve assemblies, or the moveable control 142, 242 has incremental markings (not shown) that show the relative proportion of each fluid from each cartridge 115, 215 being mixed to form the mixture.

In an embodiment illustrated in FIGS. 8-10, the adjustable valve assembly 140 is positioned adjacent to the corresponding flow channel 132 and is adjustable along an axis that is not parallel to the central axis of the corresponding flow channel 132 at the point along the flow channel at which the adjustable valve 140 is adjacent thereto. The adjustable valve assembly 140 may be configured to progressively decrease a mass flow rate of fluid drawn from the corresponding cartridge 115 when the device is in use by progressively constricting the cross-sectional area of the corresponding flow channel 132 by progressively moving the movable control 142 to a position(s) that causes the adjustable valve 140 to progressively come into contact with an exterior surface of the flow channel 132 thereby constricting the cross-sectional area of the lumen of the flow channel 132 to decrease the mass flow rate of fluid moving therethrough. Conversely, the mass flow rate of fluid that is drawn out of the cartridge 115, when the pump 150 is operational, is progressively increased by progressively moving the moveable control 142 to a position(s) that cause the adjustable valve to progressively retract from compressing an exterior surface of the flow channel 132, thereby causing the lumen of the flow channel 132 to rebound and restoring the cross-sectional area of the lumen to increase the mass flow rate of fluid moving therethrough. Examples of such an embodiment are illustrated in FIGS. 8-10, which illustrate a pinch valve (FIG. 8), a roller valve (FIG. 9), and a lever valve (FIG. 10). These examples are not intended to be limiting or inclusive, however, and any valve known to those skilled in the art is within the scope of this disclosure.

Figure 8A:
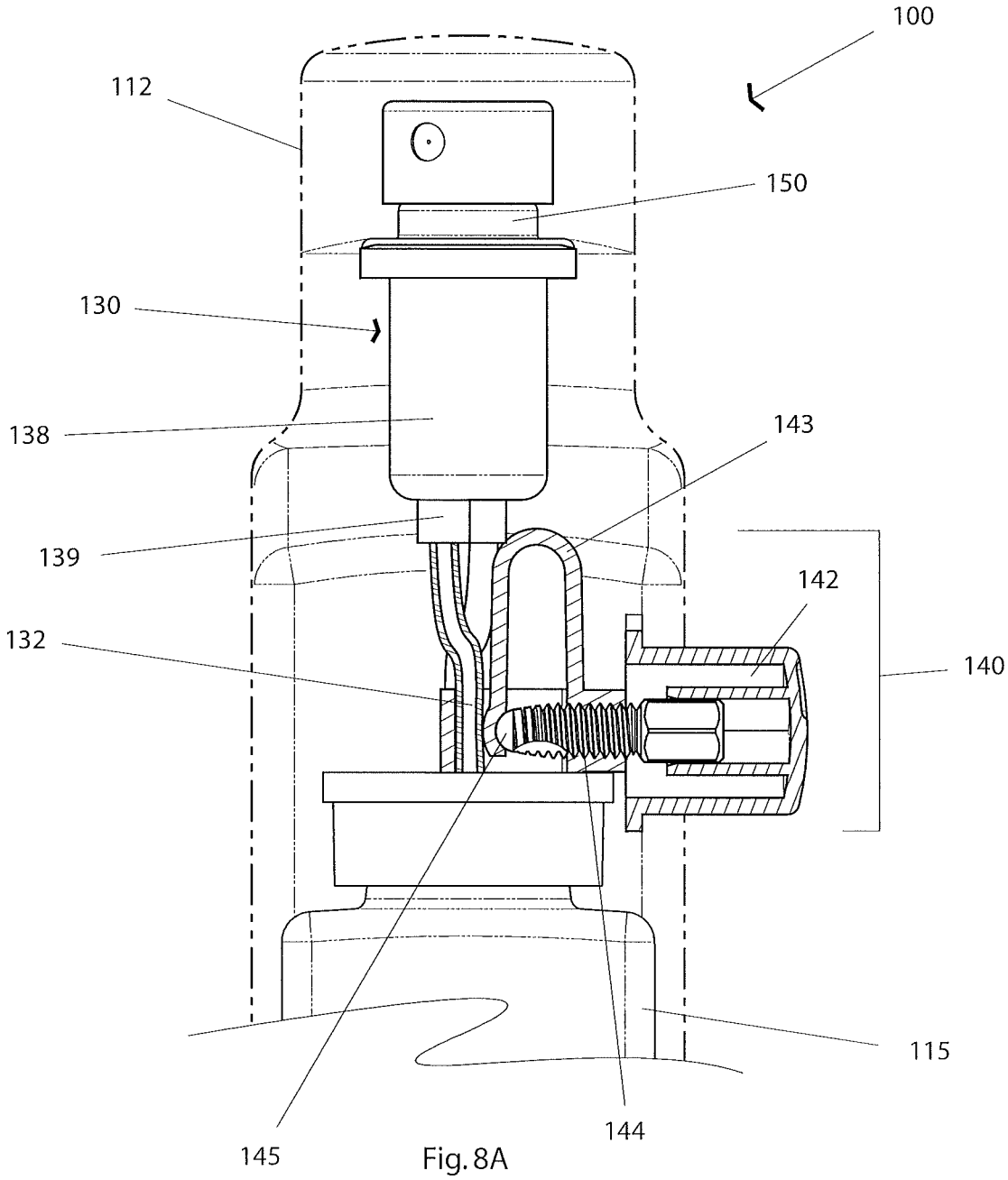
FIG. 8 is a partial cross-sectional view of the mixing and dispensing device shown in FIG. 1 taken through the valve assembly and showing a screw-actuated pinch valve in (A) the fully opened position and (B) the fully closed position.
Figure 8B:
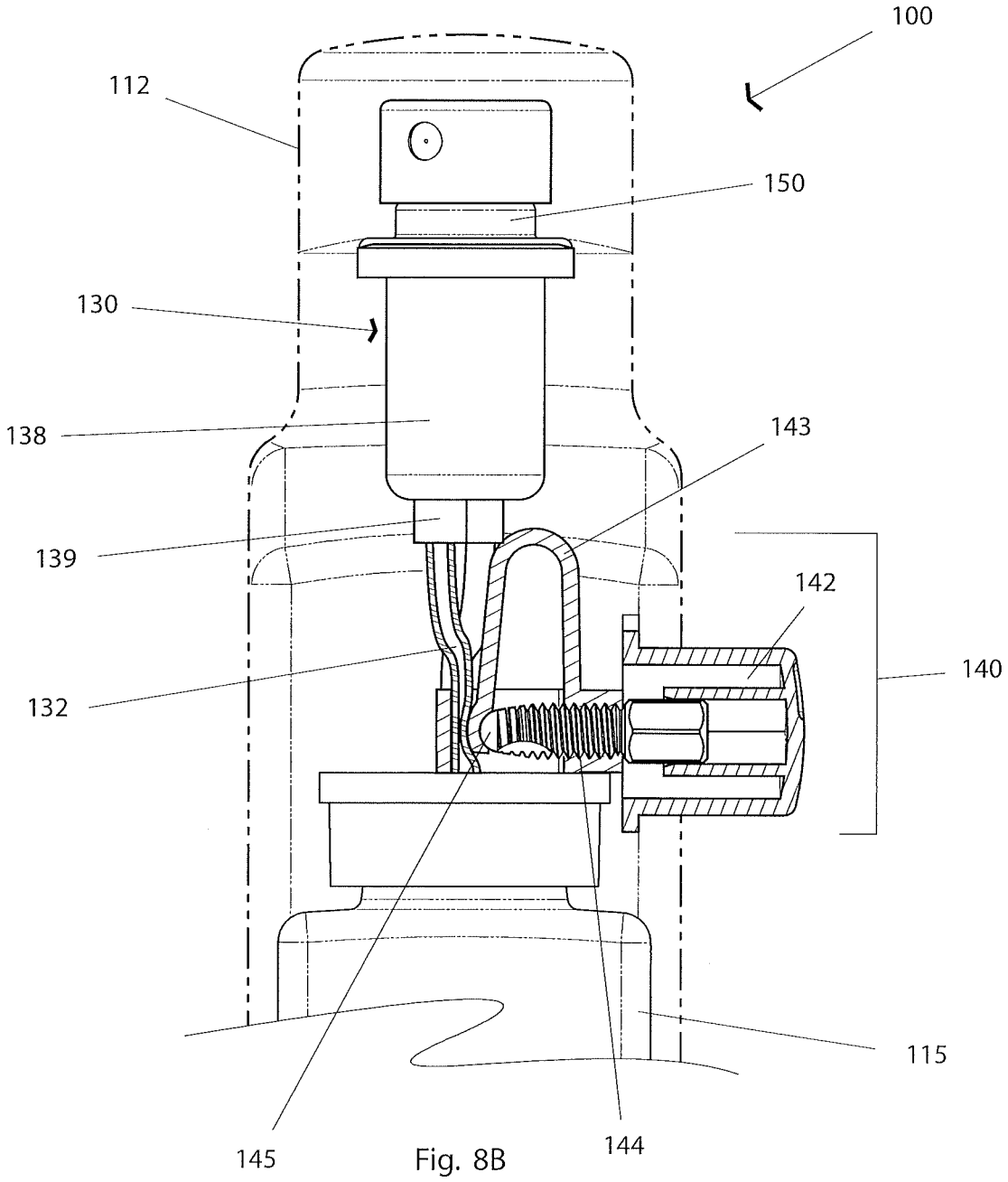

FIG. 8 illustrates a partial cross-sectional view of a device taken through the adjustable valve assembly 140 in which the adjustable valve assembly 140 is a screw-actuated pinch valve. The pinch valve 140 has a clamp 143 and a threaded shaft 144. The threaded shaft 144 has a tip 145. A control knob 142 mates with the threaded shaft 144 such that progressive axial rotation of the control knob 142 causes the threaded shaft 144 to progressively move axially towards or away from the clamp 143 to a closed (FIG. 8B) or an opened (FIG. 8A) position, respectively. In operation, the portion of the flow channel 132 between the cartridge 115 and the inlets 139 of the manifold body 138 is restricted by rotating the control knob 142 in a first direction to cause the threaded shaft 144 to move towards the clamp 143 until the clamp engages and at least partially compresses the flow channel 132 to constrict the cross-sectional area of the lumen of the flow channel 132 to decrease the mass flow rate of fluid through the flow channel 132. FIG. 8B illustrates the pinch valve 140 in the fully closed position. The fluid connection is restored by rotating control knob 142 in a second direction to cause the threaded shaft 144 to move away from and decompress the flow channel 132 to cause the lumen of the flow channel 132 to rebound, thereby at least partially restoring the cross-sectional area of the lumen and increasing the mass flow rate of fluid through the flow channel 132. FIG. 8A illustrates the pinch valve 140 in the fully opened position.

Referring to FIG. 9, a device 100 is illustrated in which the adjustable valve assembly 140 is a slide-actuated pinch valve. The pinch valve 140 has a ramp 148 and a roller 149. The flow channel 132 is positioned between the ramp 148 and the roller 149. The axis of the ramp 148 is positioned at an angle relative to the axis of movement of the roller 149. A slide switch control 142 mates with the roller 149 such that progressive linear movement of the slide switch 142 in a first direction causes the roller 149 to progressively move linearly across the ramp 148 from an open (FIG. 9A) to a closed (FIG. 9B) position to progressively compress the flow channel 132 between the roller 149 and the ramp 148 to constrict the cross-sectional area of the lumen of the flow channel 132 to progressively decrease the mass flow rate of fluid through the flow channel 132. Progressive linear movement of the slide switch 142 in a second direction causes the roller 149 to progressively decompress the flow channel 132 between the roller 149 and the ramp 148 to cause the cross-sectional area of the lumen of the flow channel 132 to rebound to progressively increase the mass flow rate of fluid through the flow channel 132.

Referring to FIG. 10, a device is illustrated in which the adjustable valve 140 is a lever-arm actuated pinch valve. The pinch valve 140 has a roller 149 and a ramp 149. The flow channel 132 is positioned between the ramp 148 and the roller 149. A lever arm control 142 pivotally mates with the roller 149 such that progressive pivoting of the lever arm 142 causes the roller 149 to progressively rotate from an open to a closed position. The progressive rotation of the lever arm 142 compresses the flow channel 132 between the roller 149 and the ramp 148 to progressively constrict the cross-sectional area of the lumen of the flow channel 132 to progressively decrease the mass flow rate of fluid through the flow channel 132. Progressive rotation of the lever arm 142 in the opposite direction causes the roller 149 to progressively decompress the flow channel 132 between the roller 149 and the ramp 148 to cause the cross-sectional area of the lumen of the flow channel 132 to rebound to progressively increase the mass flow rate of fluid through the flow channel 132. FIG. 10 shows the pinch valve 140 in the partially open position.

In another embodiment illustrated in FIG. 11, the adjustable valve 140 is positioned within the lumen of the flow channel 132 and progressively decreases the mass flow rate of fluid that is drawn out of the corresponding cartridge 115 through the adjacent flow channel 132 by progressively advancing a needle tip 141 of the valve into the lumen of the flow channel 132 thereby progressively constricting the cross-sectional area thereof. Conversely, in operation, the adjustable valve increases the mass flow rate of fluid that is drawn out of the corresponding cartridge through the adjacent flow channel by progressively retracting the needle tip 141 of the valve from the lumen of the flow channel 132 thereby progressively increasing the cross-sectional area thereof Examples of such an embodiment of the adjustable valve 140 include a needle valve (FIG. 11), a ball valve (not shown), or any other type of valve known to those skilled in the art that progressively occludes or expands the fluid path.

Figure 11A:
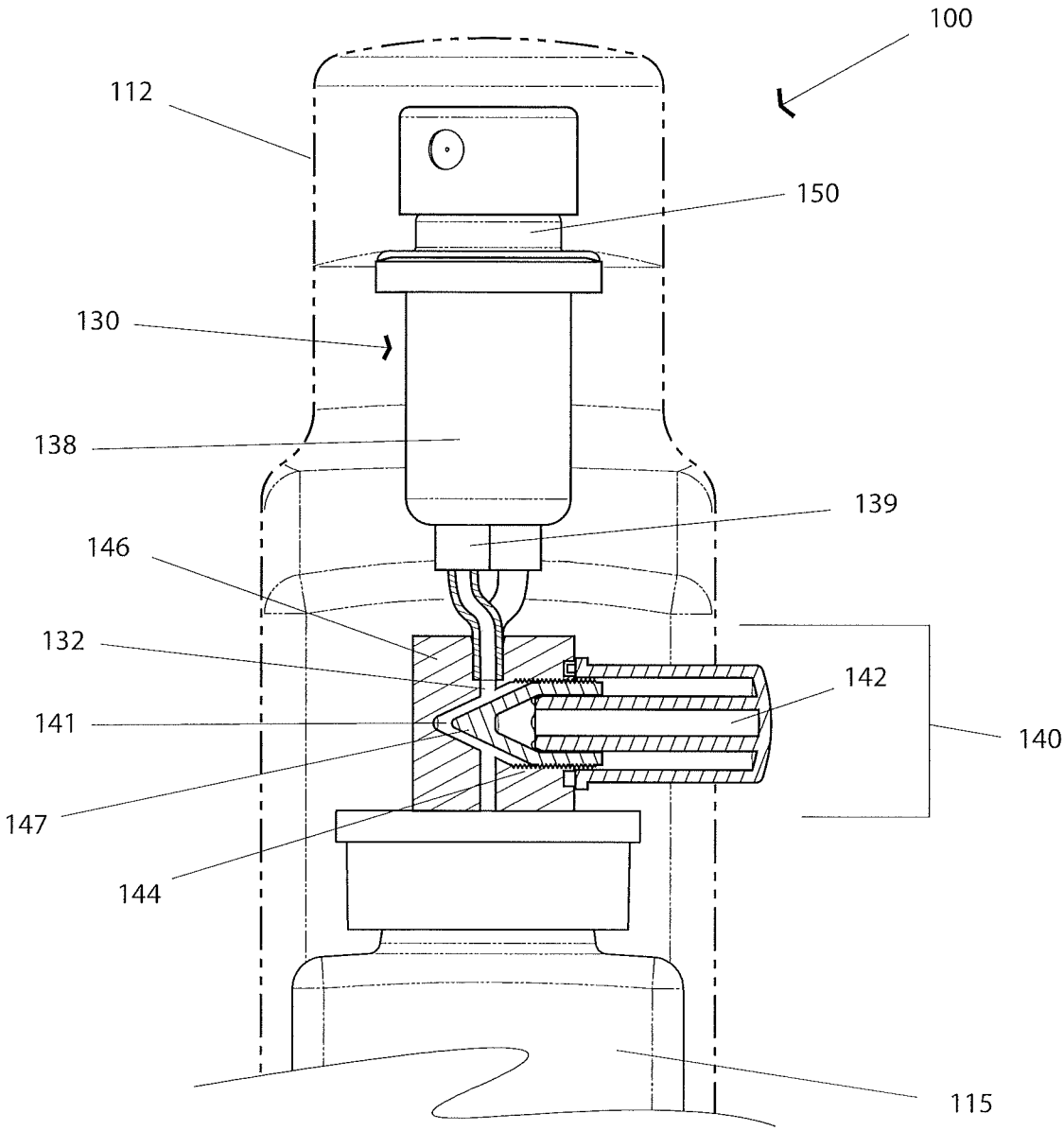
FIG. 11 is a partial cross-sectional view of an embodiment of a mixing and dispensing device taken through the valve assembly and showing a needle valve in (A) the fully opened position and (B) the fully closed position.
Figure 11B:
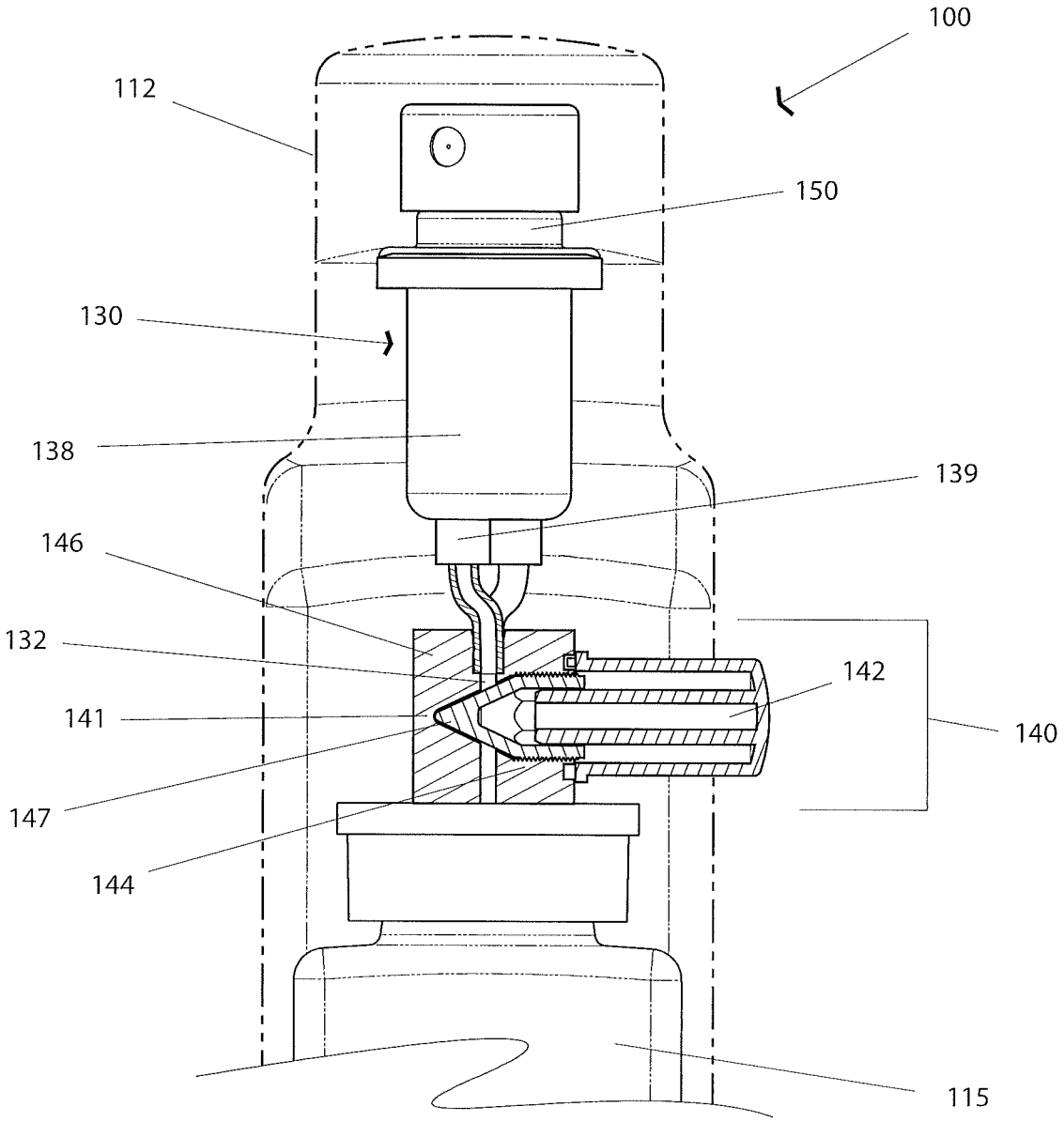

Referring to particularly to FIG. 11, a device is illustrated in which the adjustable valve 140 is a needle valve that is positioned within the lumen of the flow channel. The needle valve 140 has a valve body 146, a conical needle 147, and a control knob 142. The conical needle 147 is positioned within a conical channel (not shown) in the valve body 146 and includes a distal tip 141 and a proximal threaded shaft 144. The control knob 142 is substantially aligned with the needle axis such that progressive rotation of the control knob 142 causes the needle 147 to move progressively axially within the flow channel of the valve body 146 to progressively adjust flow rate. FIG. 11A shows the needle valve 140 in the fully opened position and FIG. 11B shows the needle valve 140 in the fully closed position.

Figure 7A:
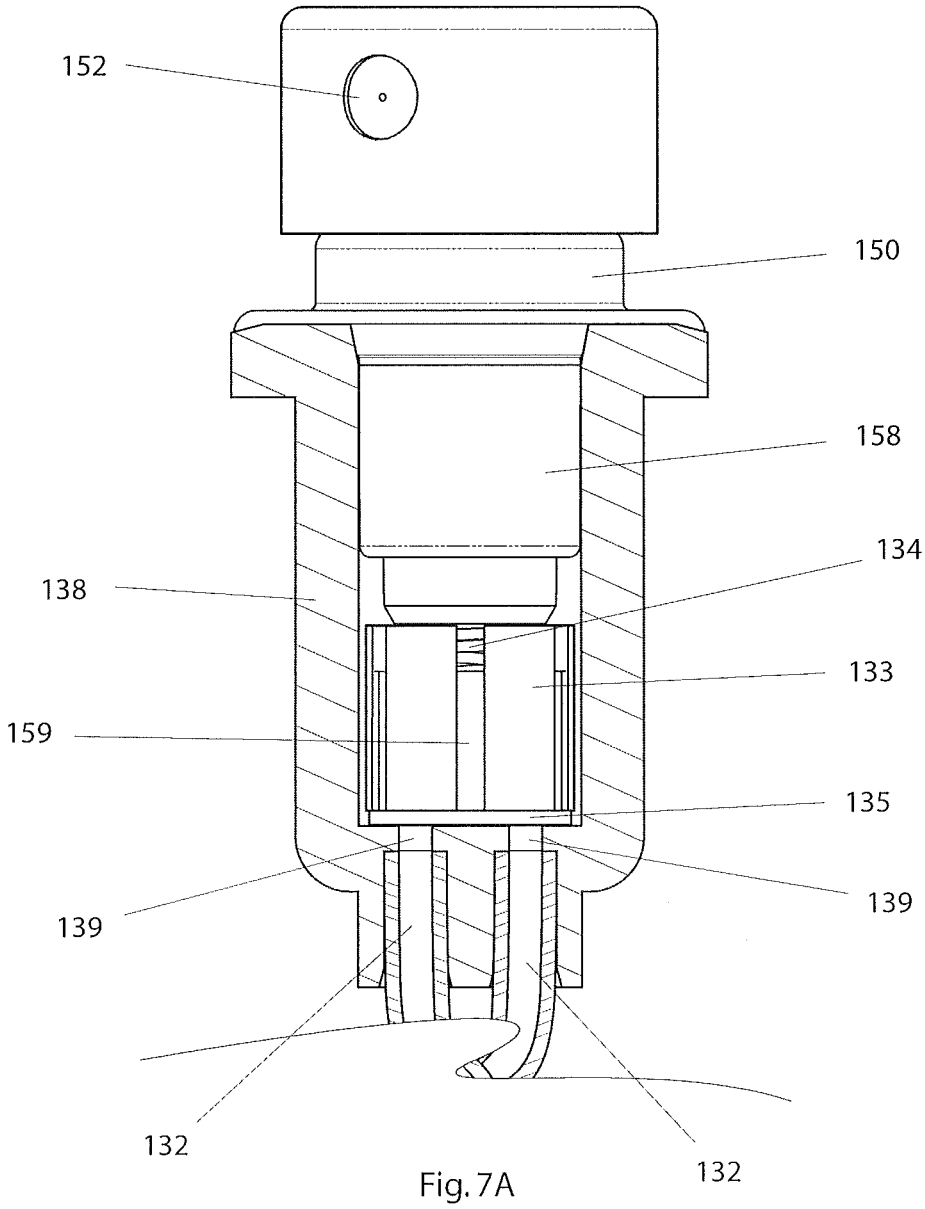
FIG. 7 illustrates an orthographic front view of an embodiment of the manifold assembly (with the manifold body shown in cross-section for clarity), dispensing pump, and nozzle (A) in a resting state, (B) in an actuated state, and (C) in a rebound state.
Figure 7B:
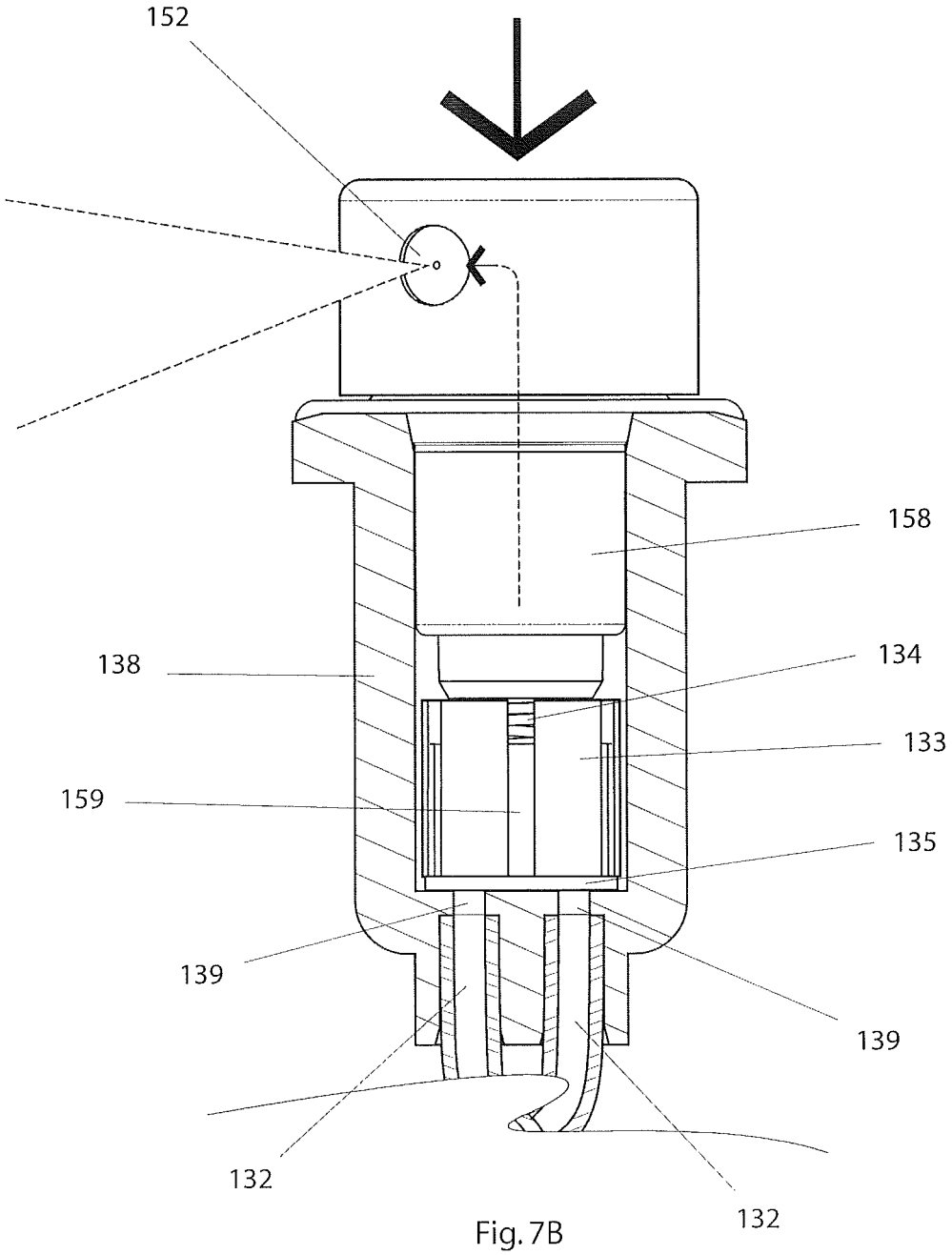
Figure 7C:
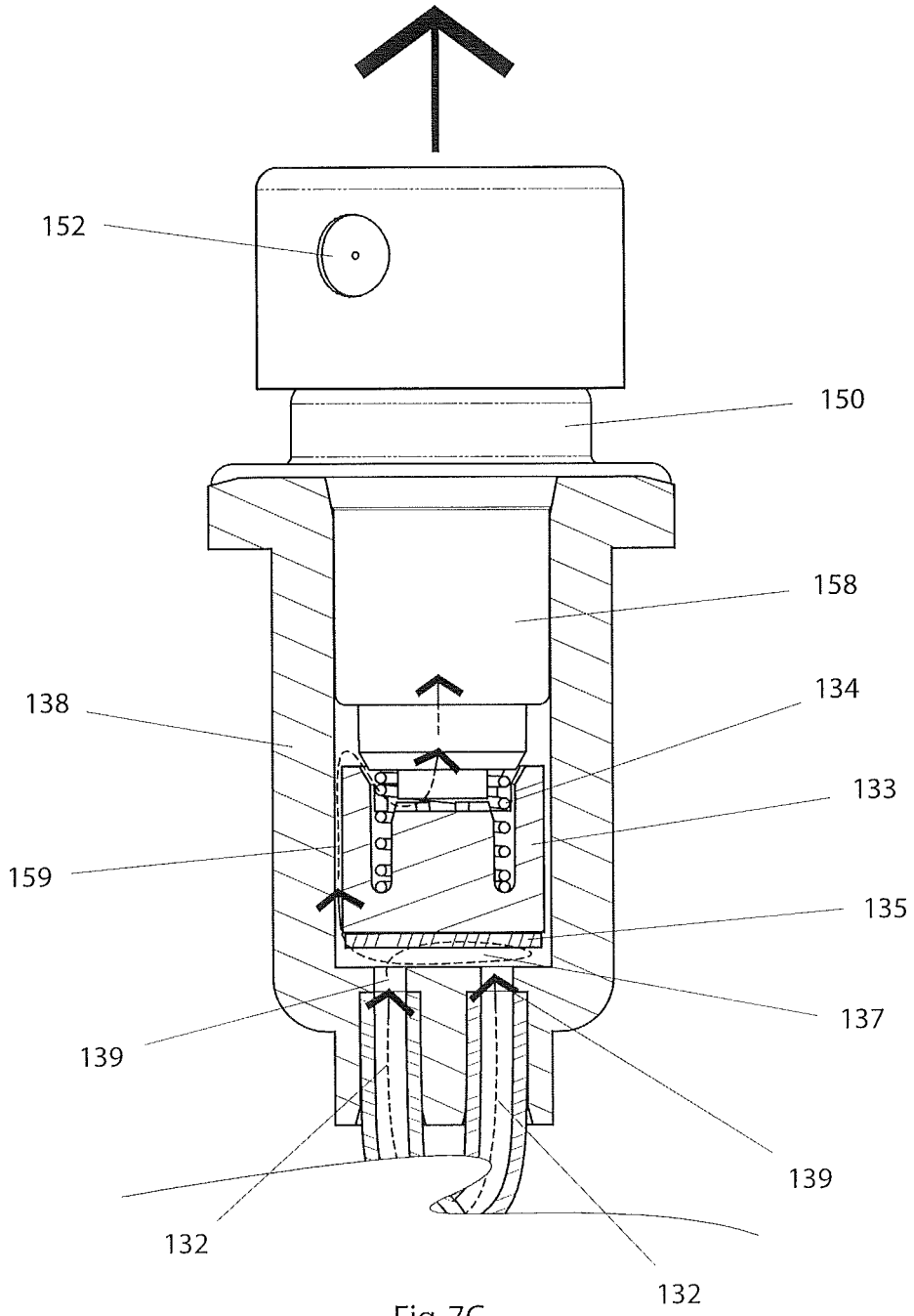

Referring now to FIGS. 1, 2, and 5-7, the mixing and dispensing device 100, 200 has a manifold assembly 130, 230. The system at rest is illustrated in FIG. 7A. As illustrated in FIGS. 1, 2 and 7, the manifold assembly 130, 230 is configured to communicate through inlets 139, 239 with each of the flow channels 132, 232 to receive fluid from each corresponding cartridge 115,215 and to mix the fluids to form a mixture during operation of the device 100, 200. As illustrated particularly in FIG. 7C, when the dispensing pump assembly 150 is in the rebound state, fluid is drawn by the dispensing pump assembly 150 into the mixing chamber 137 through an inlet 139 from the cartridge 115 of the corresponding cartridge assembly to mix the selected volume of fluids to formulate the mixture in the mixing chamber 137 and to transport the mixture to the dispensing pump assembly 150. When the nozzle 152 is subsequently depressed (i.e., the dispensing pump assembly is in the actuated state), the mixture is expelled from the dispensing pump assembly 150 through the nozzle 152 (FIG. 7B).

Figure 5A:
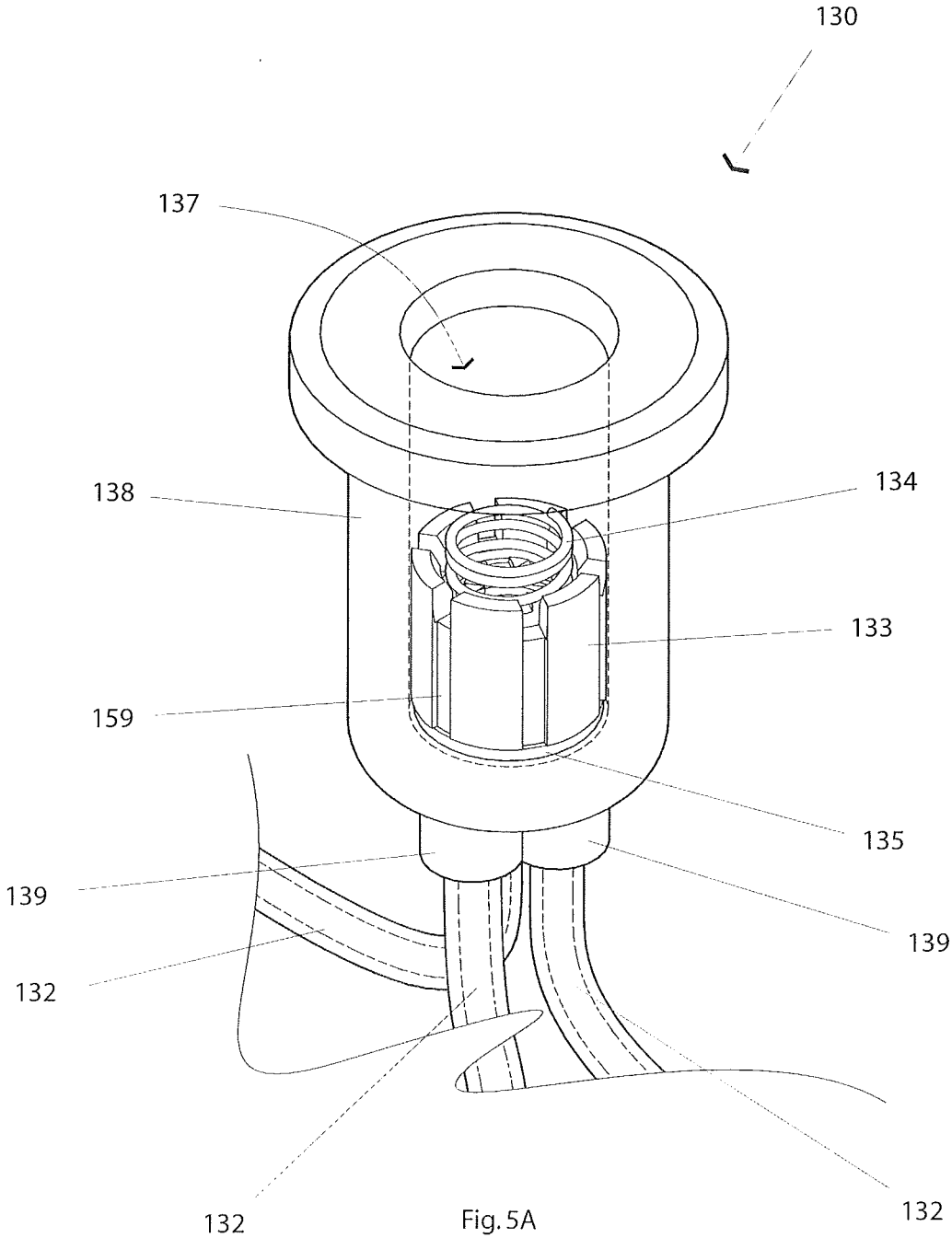
FIG. 5 is an embodiment of the manifold assembly, showing (A) an isometric view with the manifold body shown transparent for clarity, and (B) an exploded isometric view.

As illustrated in FIG. 5, the manifold assembly 130 comprises a manifold body 138. The manifold body 138 has at least one side wall and a base that define a mixing chamber 137. See FIGS. 5, 6. The volume capacity of the mixing chamber 137 varies with actuation and rebound of the dispensing pump assembly 150 (FIG. 7 and FIG. 4, described below). There is a plurality of inlets 139 on any surface of the manifold body 138. As illustrated generally in the figures, inlets 139 are in the base of the manifold body 138. In other embodiments (not shown), inlets 139 are in at least one side wall of the manifold body 138. Each inlet 139 is configured to communicate with a flow channel 132 of a corresponding cartridge assembly 120. In embodiments, the inlets 139, 239 of the manifold assembly 130, 230 are configured in a linear (FIG. 1) or a radial (FIG. 2) configuration.

Figure 5B:
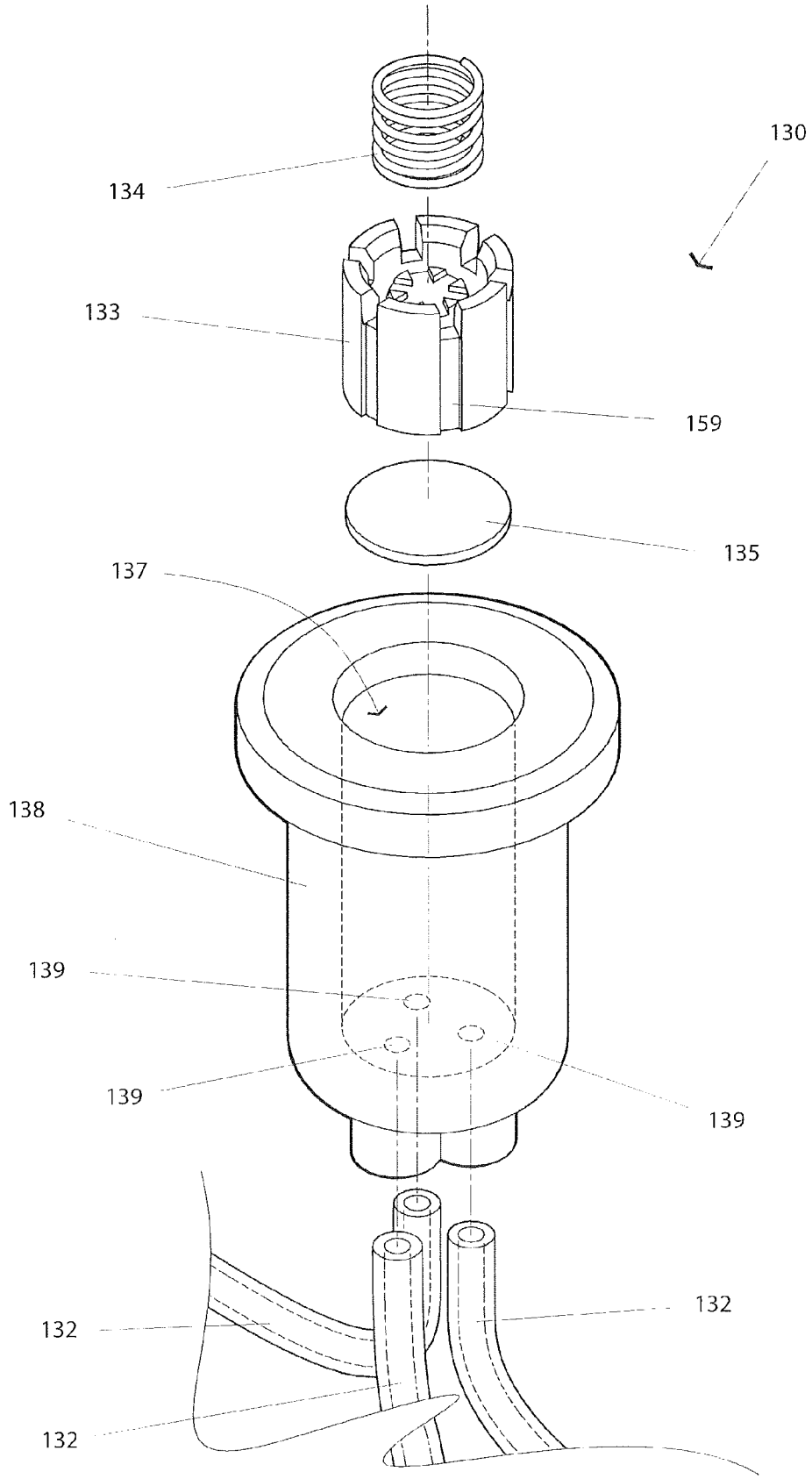
Figure 6A:
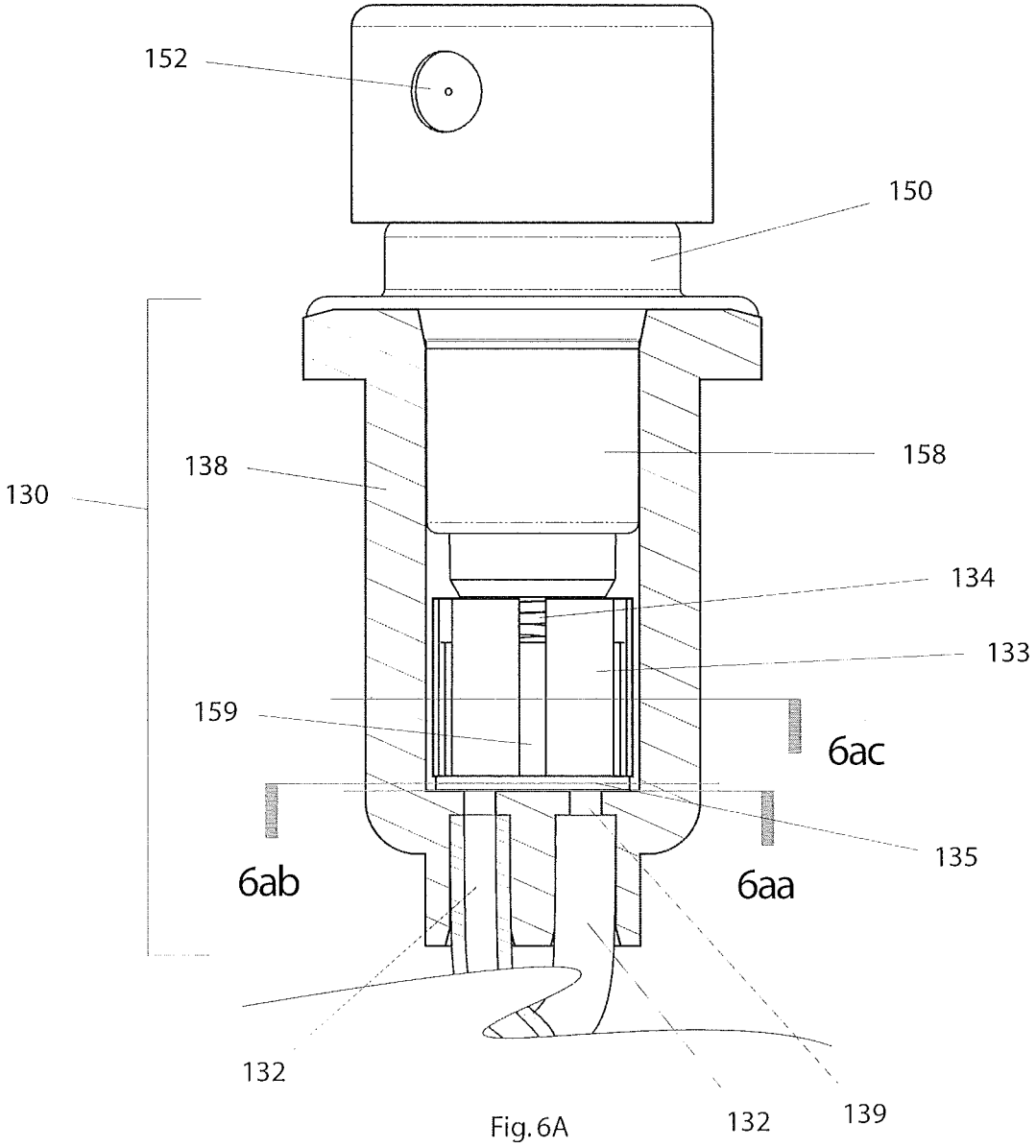
FIG. 6 is an orthographic front view of an embodiment of the manifold assembly illustrated in FIG. 5 (with the manifold body shown in cross-section for clarity) in combination with a dispensing pump and nozzle, and illustrating (A) the seal in the fully closed position, (B) horizontal cross-sectional views of the manifold assembly taken along lines 6*aa*, 6*ab*, and 6*ac* shown in FIG. 6A, and (C) the seal in the fully opened position.
Figure 6B:
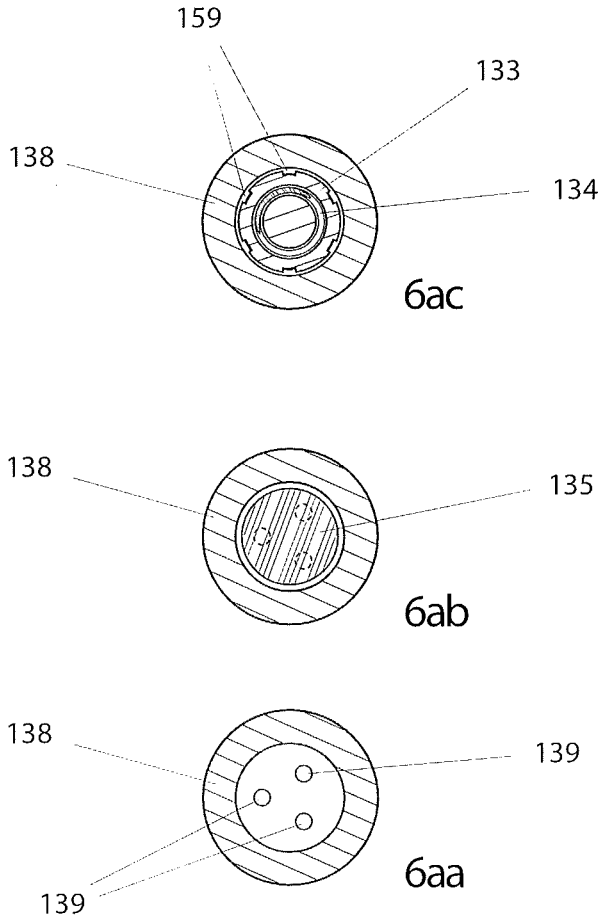
Figure 6C:
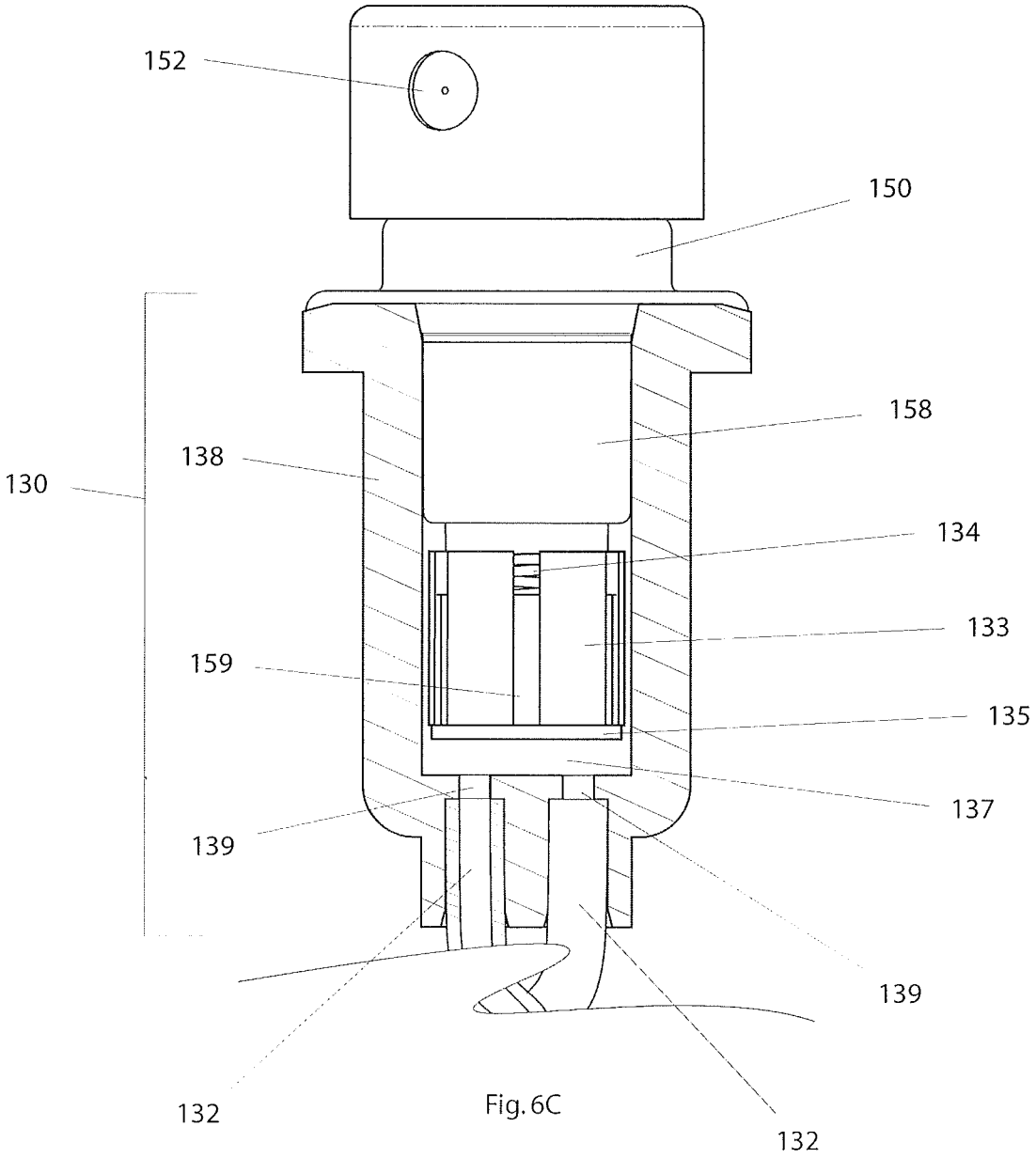

As illustrated in FIG. 5, the manifold assembly 130 also has a seal 135 disposed within the mixing chamber 137 adjacent to the inlets 139 to substantially and simultaneously seal the inlets 139 as soon as the pump 150 is in a fully rebounded state and when the system is at rest in order to prevent the flow of fluid from the cartridges 115 through the flow channels 132 at any time other than when the dispensing pump assembly 150 is actuated. In embodiments, the seal 135 is a disc (FIG. 5B), a conical interface (not shown), or any other configuration that is sized and shaped to substantially and simultaneously seal the inlets 139. The seal 135 is a face seal configured to substantially and simultaneously seal all of the inlets closed when the device 100 is not in operation to close communication between the mixing chamber 137 and the flow channels 132 in order to substantially prevent the anterograde movement of fluid from the cartridges 115 or flow channels 132 into the mixing chamber 137, to substantially prevent the retrograde movement of fluid from the mixing chamber 137 into the flow channels 132 or the cartridges 115, and cross-flow between flow channels 132 when the device 100 is not in operation. The configuration of the seal 135 to substantially and simultaneously seal the inlets 139 closed provides unexpected and surprising results in substantially preventing anterograde and retrograde fluid flow between the components 115, 132, 140 of the device when the device is not in use compared to other seals known in the art such as umbrella valves and the like, which cannot consistently open all of the inlets simultaneously, particularly where a plurality of flow channels each have a different mass flow rate.

Referring still to FIG. 5, the manifold assembly 130 also has a spring 134 disposed within the mixing chamber 137. The spring 134 is moveable between a compressed position and an extended position. A piston 133 is disposed within the mixing chamber 137 between the seal 135 and the spring 134. When the device 100 is not in operation, the inlets 139 are substantially sealed by the seal 135. The outer diameter of the piston 133 is substantially the same as the inner diameter of the mixing chamber 137 to substantially limit the movement of the piston 133 within the mixing chamber 137 to a linear movement along a central axis within the mixing chamber 137. In an embodiment, the side walls of the piston 133 have a plurality of channels 159 that extend substantially parallel to the central axis of the mixing chamber 137. The channels 159 are configured to allow a small amount of fluid to flow past the piston 133 in order to decrease the frictional engagement of the outer surface of the piston side walls against the inner surface of the mixing chamber 137.

As illustrated in FIG. 7, the mixing and dispensing device 100 also has a dispensing pump assembly 150 that is configured for communication with the mixing chamber 137 and a nozzle 152 that is positioned downstream from the dispensing pump assembly 150. The dispensing pump assembly 150 has a pump chamber (not shown) that is defined by a pump body 158 having side walls and a base. The dispensing pump assembly 150 is configured to draw fluid from each of the cartridge assemblies 120 through the flow channels 132 into the mixing chamber 137 via the inlets 139 and to the pump chamber. The dispensing pump assembly 150 may be any pumping system known to those skilled in the art that has a manual pumping action. In an embodiment, the pump chamber compressively drives the fluid through the nozzle 152. In another embodiment (not shown), the dispensing pump assembly 150 is electronically actuated with a manually actuated button that electronically operates the dispensing pump assembly 150 by means of a motor drive, for example. In other embodiments (not shown), the dispensing pump assembly 150 includes a piston with wiper seals driven through a cylinder and in combination with at least one check valve or wiper seal and a return spring.

Referring generally to the figures, and particularly to FIGS. 1, 2, and 7, the nozzle 152, 252 is configured for communication with the dispensing pump assembly 150, 250 and is configured to dispense the mixture when the device is in operation. The nozzle 152, 252 may be any of a variety of types of nozzle that is configured to dispense a spray, mist, drop, stream, etc. of a mixture of fluids.

FIGS. 1A, 2A, and 7 illustrate the flow of fluids through the mixing and dispensing device. Referring to FIGS. 1A, 2A, a fluid is contained in each cartridge 115, 215 and moves through the flow channels 132, 232 into the manifold assembly 130, 230 via the inlets 139, 239 and to the dispensing pump assembly 150, 250 for expulsion through the nozzle 152, 252. At rest (FIG. 7A), there is substantially no fluid flow through the device 100. As illustrated in FIG. 7A, the dispensing pump assembly 150 is positioned such that the spring 134 of the manifold assembly 130 is extended and engaged with the piston 133 of the manifold assembly 130 such that the piston 133 forces the seal 135 against the inlets 139 to substantially seal the inlets 139 closed. In operation of the device 100, a user adjusts the adjustable valve assemblies 140 to adjust a mass flow rate of fluid through the flow channels 132. The mixture of fluids is formulated by depressing the nozzle 152 (FIG. 7B) to actuate the dispensing pump 150 to express any prior mixture in the mixing chamber 137. The rebound of the dispensing pump assembly 150 (FIG. 7C) draws fluids at the adjusted settings from the cartridge assemblies 120. In the rebound state, the force of fluids being drawn from the cartridge assemblies 120 into the flow channels 132 and the inlets 139 forces the spring 134 to a compressed position that moves the seal 135 away from the inlets 139 to allow the fluids to enter the mixing chamber 137 to formulate the mixture at the user-adjusted setting. The mixture is then expelled through the nozzle 152 by depressing the nozzle 152.

Optionally, the mixing and dispensing device 100, 200, 300, 400, 1200 includes a purging assembly (not shown) to substantially remove any trace amounts of each fluid that remains in each flow channel following operation of the device. The purging assembly has a cartridge assembly that comprises a cartridge that contains a solvent and that communicates with the flow channels 132 of the device 100 to communicate with the manifold assembly 130, the dispensing pump 150, and the nozzle 152. The cartridge assembly has an adjustable valve that opens or closes the flow channel to communication with an inlet in the manifold body to draw fluid into the mixing chamber, and pump the solvent through the mixing chamber and dispensing pump and out the nozzle. Optionally, a cartridge containing a solvent solution may be interchanged with one or each cartridge such that the solvent solution is flushed through the flow channels, manifold assembly, dispensing pump, and nozzle to substantially remove any fluids or mixture of fluids therefrom.

In another embodiment of the device illustrated in FIG. 3, the device 300 has at least two cartridge assemblies 320 each comprising a cartridge 315. The cartridges 315 are the same as cartridges 115 described in connection with device 100, except that each cartridge 315 is positioned within the cartridge assembly 320 in a position that is inverted relative to the position of cartridge 115 in the cartridge assembly 120. The cartridge assemblies 320 are positioned linearly, non-linearly, or radially relative to each other as described in connection with the cartridge assemblies of the device 100. The cartridge assemblies 320, the manifold assembly 330, and the pump 350 are enclosed in a body 312. The body 312 is as described in connection with the body 112 of the device 100.

As illustrated in FIG. 3, each cartridge 315 has closure device 318, port 316, vent 313, optional bladder (not shown) as described in connection with the closure device 118, the port 116, and the vent 113, respectively.

A spike plate 314 is positioned upstream to the cartridge assemblies 320 and has at least two cannulated spikes 314*a* and at least two uptube ports (not shown). Each spike 314*a* has a proximal end that is configured to communicate with an interior of a corresponding cartridge 315.

The device 300 has at least two flow channels 332 each configured to communicate with an interior of a corresponding one of the cartridges 315 via coupling (not shown) that is mounted on or integral with the spike plate 314. Each spike 314*a* communicates with a corresponding coupling via a channel (not shown) that is formed below a surface of the spike plate 314 to transfer fluid from the cartridge 315 to the flow channel 332. The flow channels 332 are the same as flow channels 132 described in connection with device 100. The distal end of the flow channel 232 is connected to the corresponding coupling or uptube port (not shown) and the proximal end of the flow channel 332 communicates with a corresponding inlet 339 of the manifold 330.

The device 300 has at least two adjustable valves 340 each positioned to communicate with a corresponding one of the flow channels 332 and that adjusts mass flow rate of fluid that is drawn by the pump 350 from the corresponding cartridge 315 through the flow channel 332 each time the pump 350 rebounds. The adjustable valves 340 are the same as adjustable valves 140 described in connection with device 100.

As illustrated in FIG. 3, the mixing and dispensing device 300 has a manifold assembly 330 positioned downstream to the adjustable valve 340. The manifold assembly 330 is the same as the manifold assembly 130 described in connection with the device 100. The manifold assembly 330 comprises a manifold body 338 that has at least one side wall and a base that define a mixing chamber 337. There is a plurality of inlets 339 on any surface of the manifold body 338. Manifold assembly 330 is the same as manifold assembly 130 illustrated in FIG. 5, and has a seal 135 disposed within the mixing chamber 137 adjacent the inlets 139 and a spring 134 disposed within the mixing chamber 137. The spring 134 is moveable between a compressed and an extended position as described in connection with FIG. 7. A piston 133 is disposed within the mixing chamber 137 between the seal 135 and the spring 134. Each inlet 339 is configured to communicate with a flow channel 332 of a corresponding cartridge assembly 320.

As illustrated in FIG. 3, the mixing and dispensing device 300 also has a dispensing pump assembly 350 positioned downstream to the manifold assembly 330. The dispensing pump assembly 350 is configured to communicate with a nozzle 352 that is positioned downstream thereto. The dispensing pump assembly 350 and nozzle 352 are as described in connection with the dispensing pump 150 and the nozzle 152, respectively.

Figure 3A:
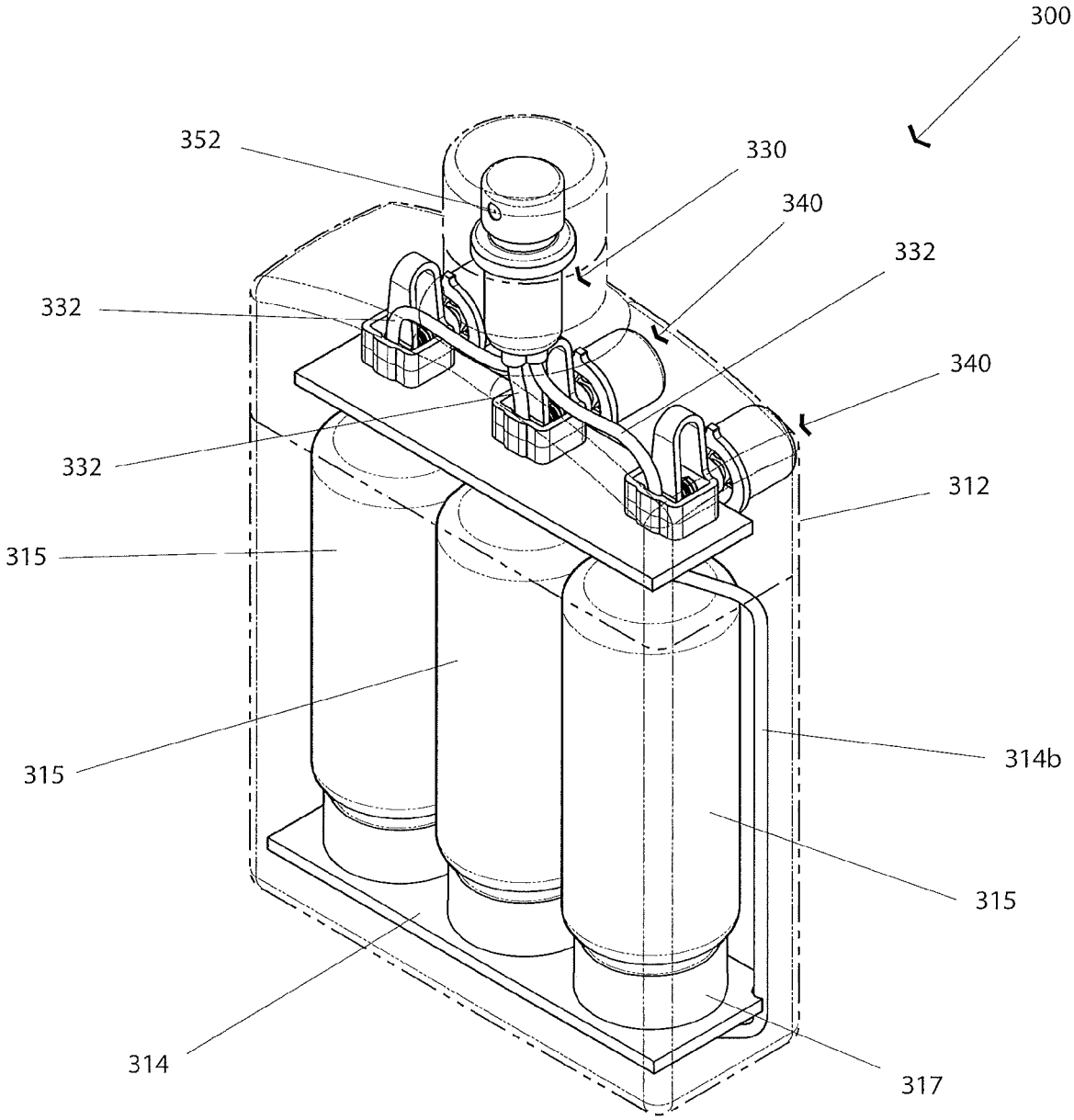
FIG. 3 is another embodiment of the mixing and dispensing device illustrating inverted cartridge assemblies, showing (A) a front isometric view, (B) a rear isometric view, (C) a side elevation view and including dashed arrows that illustrate the flow of fluid through the device when the device is in operation, (D) an exploded view, (E) a cross-sectional view through an inverted cartridge in combination with the spike plate and showing the cartridge detached from the spike plate, and (F) a cross-sectional view through an inverted cartridge in combination with the spike plate and showing the cartridge attached to the spike plate.
Figure 3B:
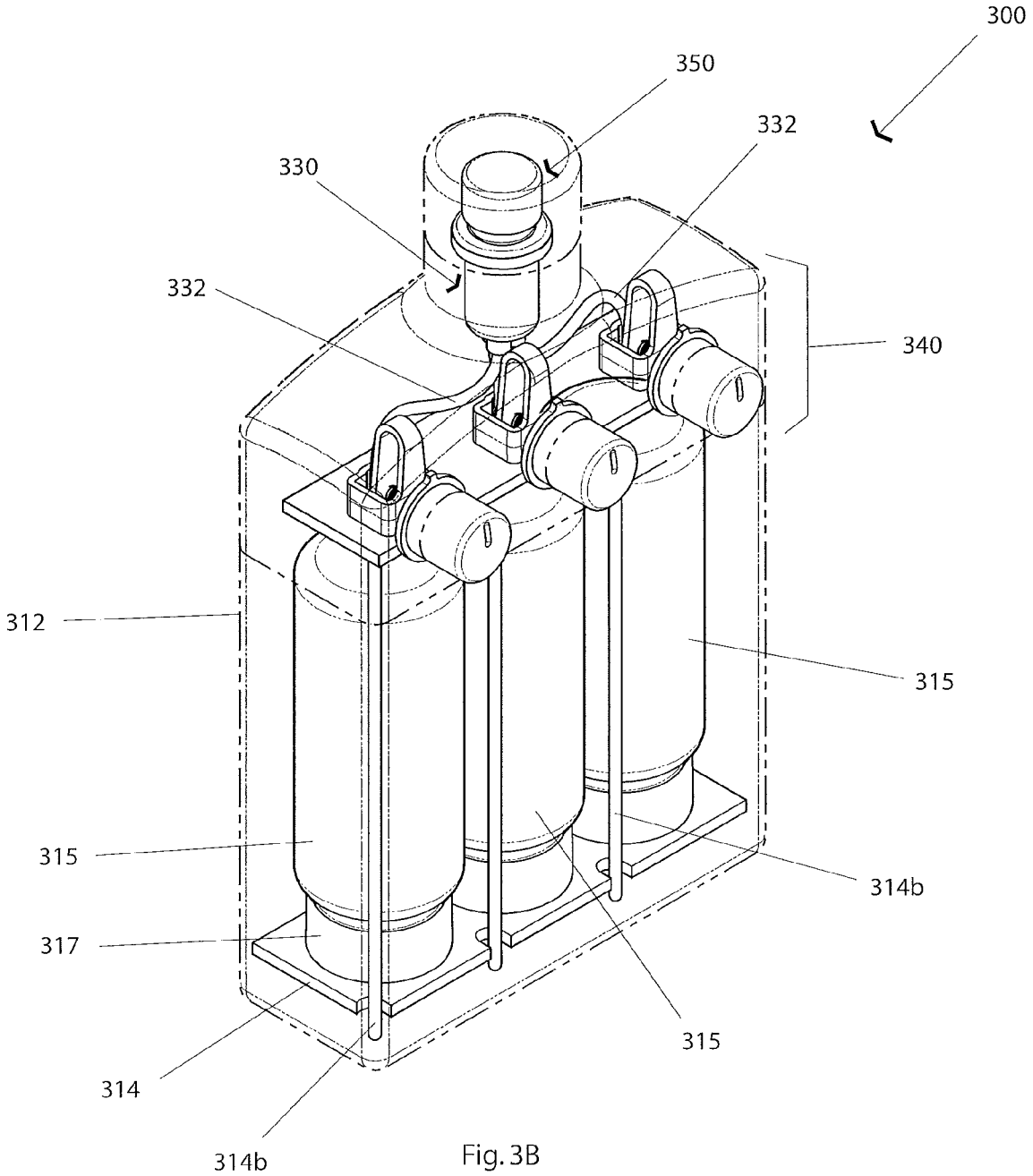
Figure 3C:
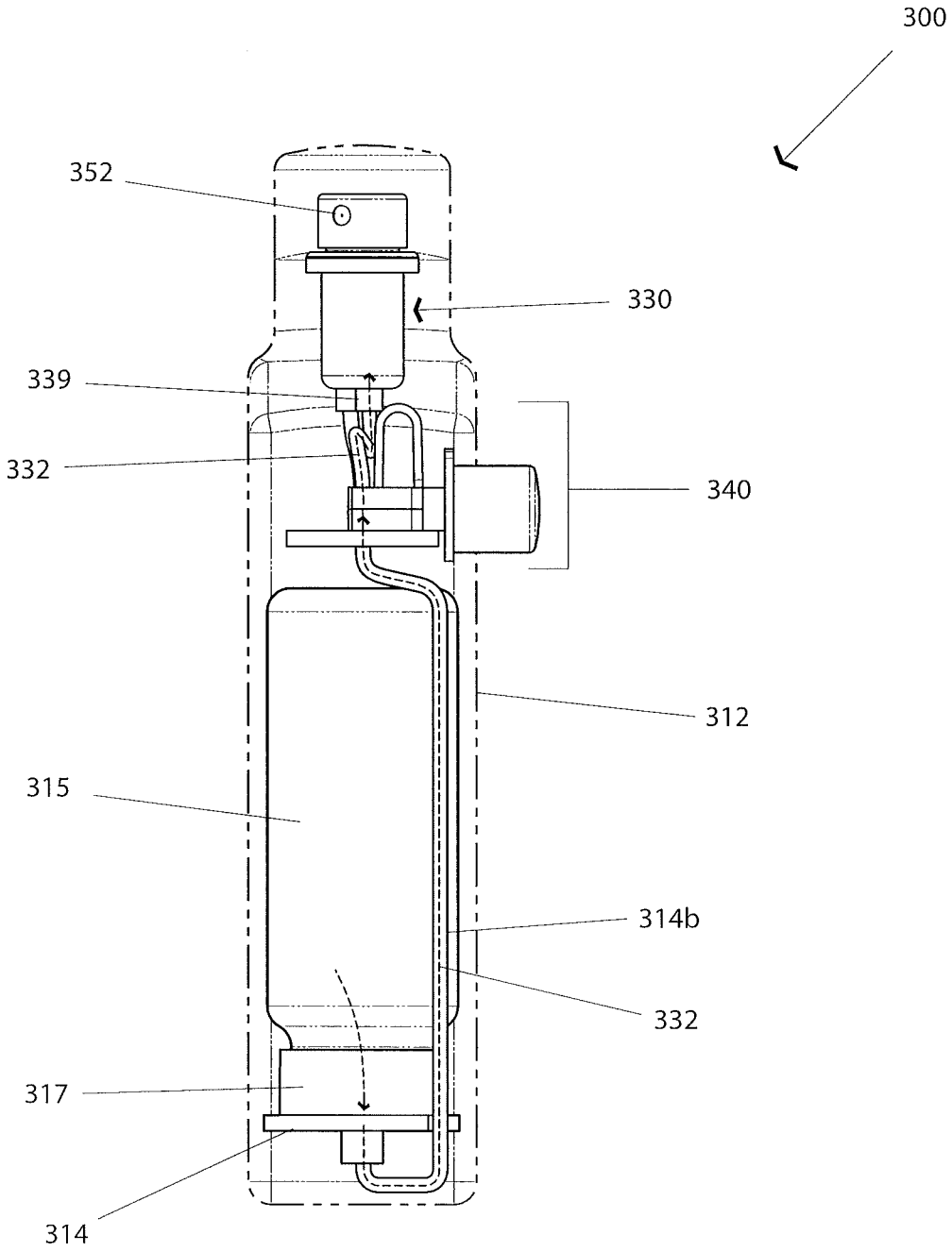
Figure 3D:
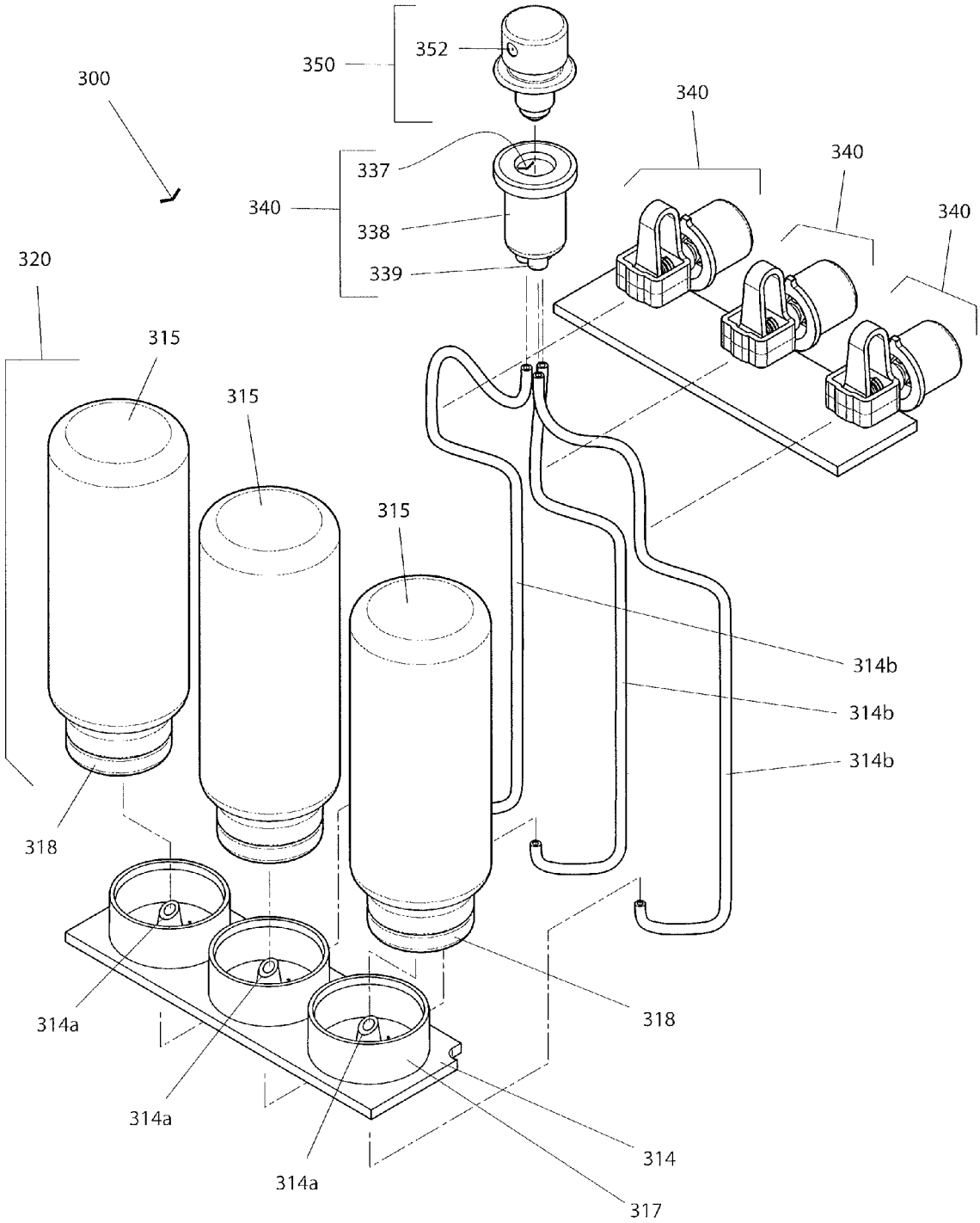
Figure 3E:
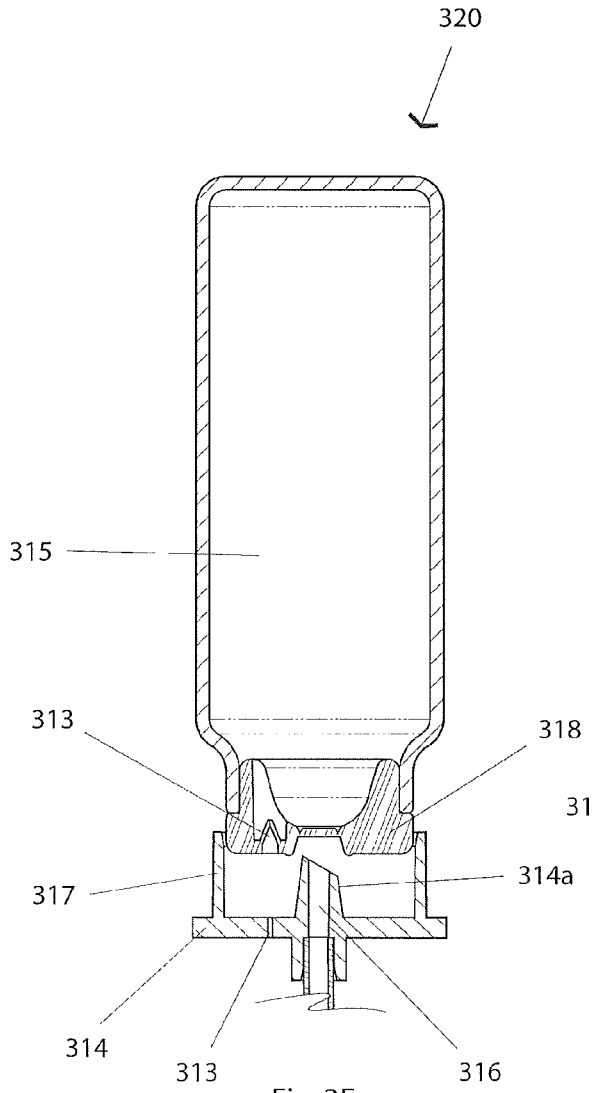
Figure 3F:
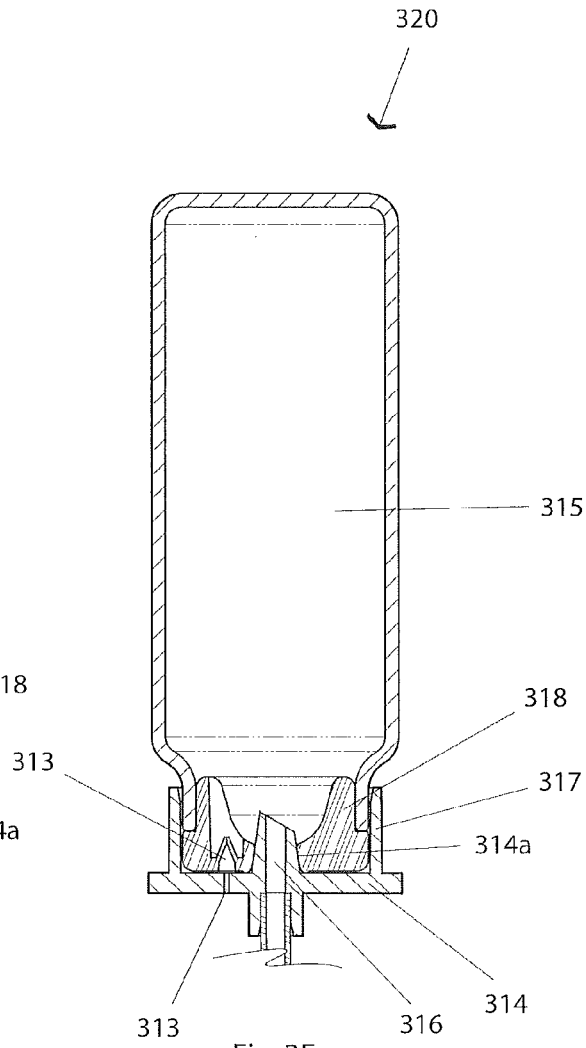
Figure 4A:
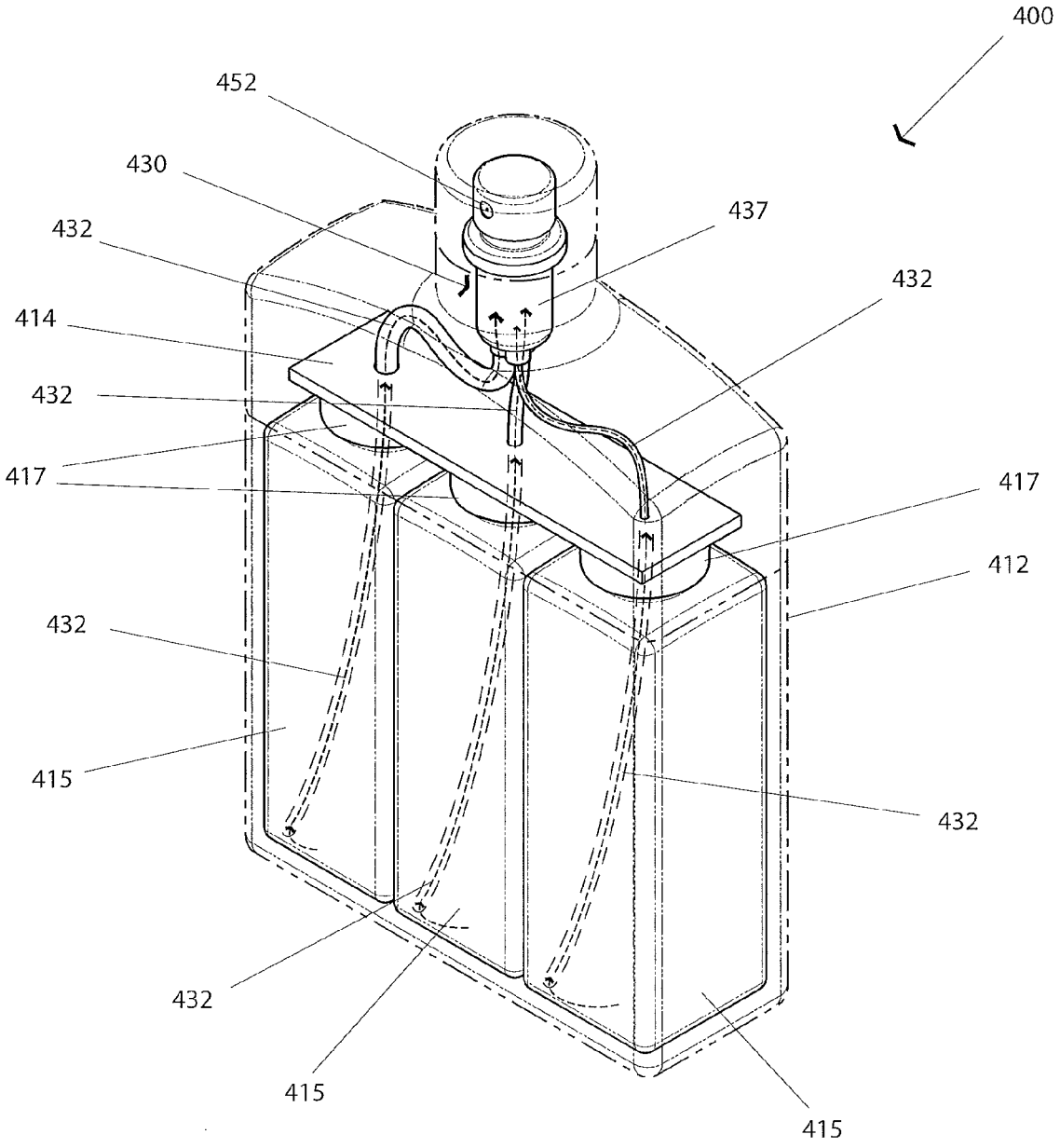
FIG. 4 is another embodiment of the mixing and dispensing device illustrating flow channels having lumens of differing cross-sectional areas, showing (A) a front isometric view and including dashed arrows that illustrate the flow of fluid through the device when the device is in operation, (B) a rear isometric view, (C) a side elevation view, and (D) an exploded view.
Figure 4B:
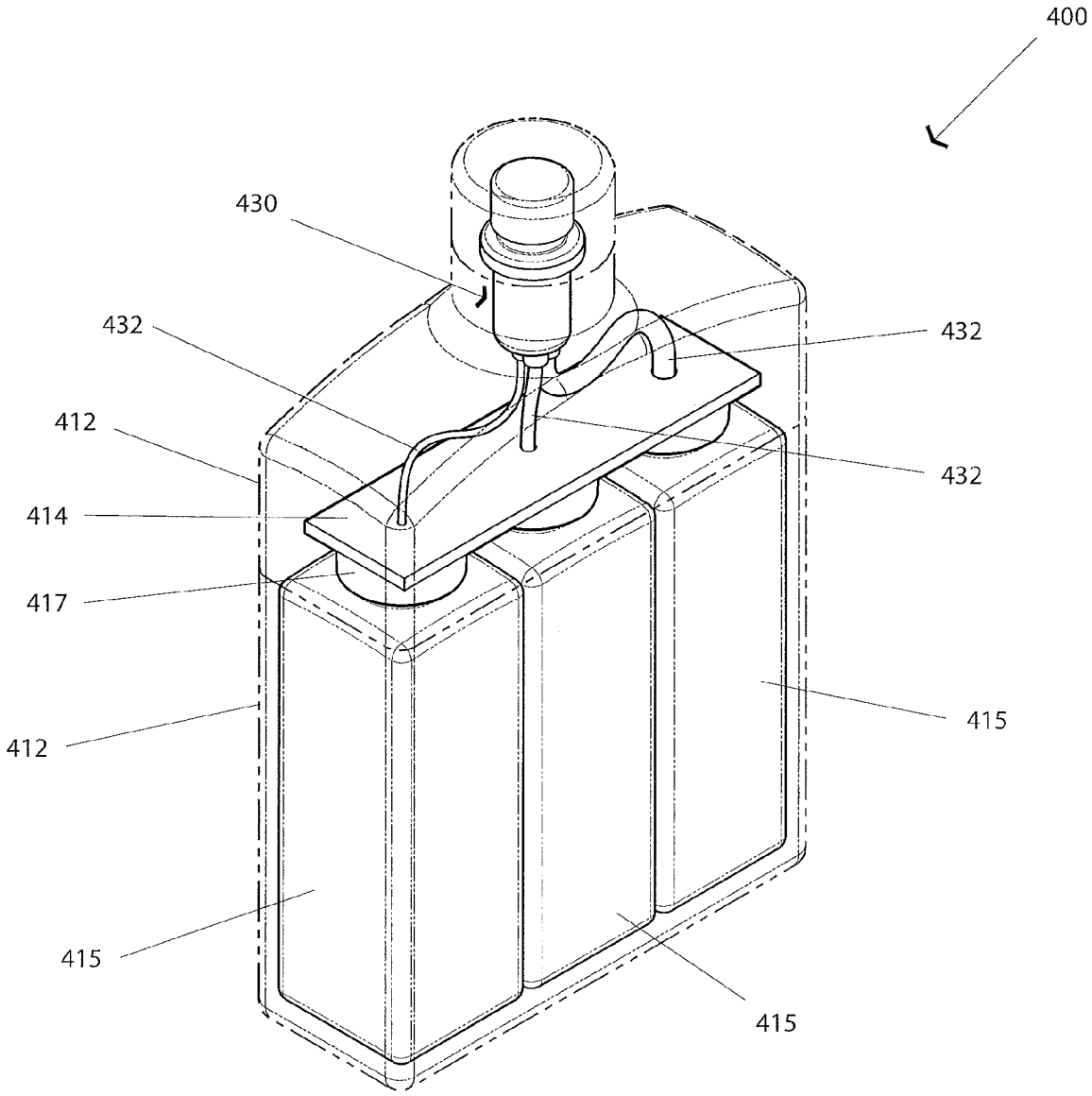
Figure 4C:
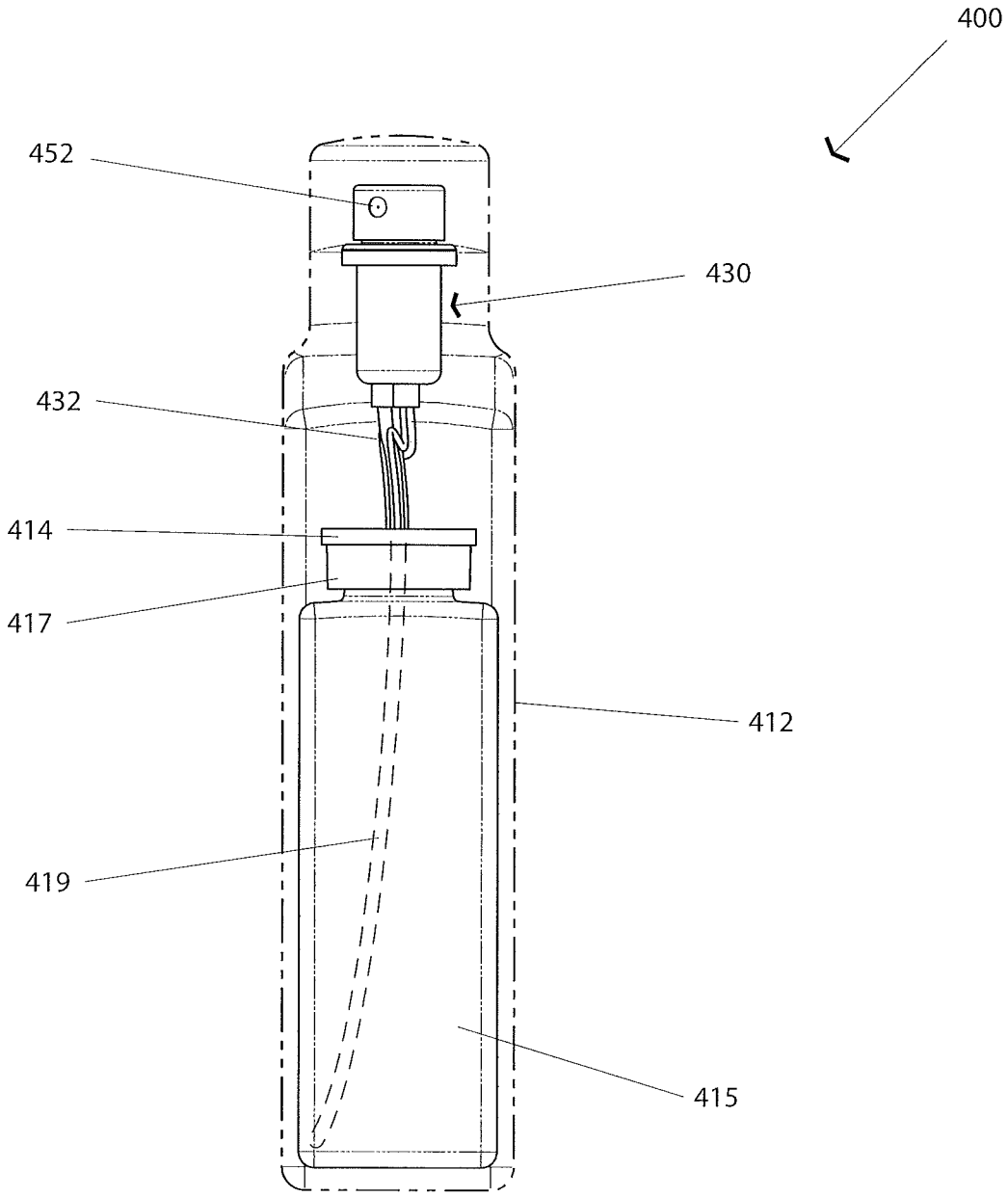
Figure 4D:
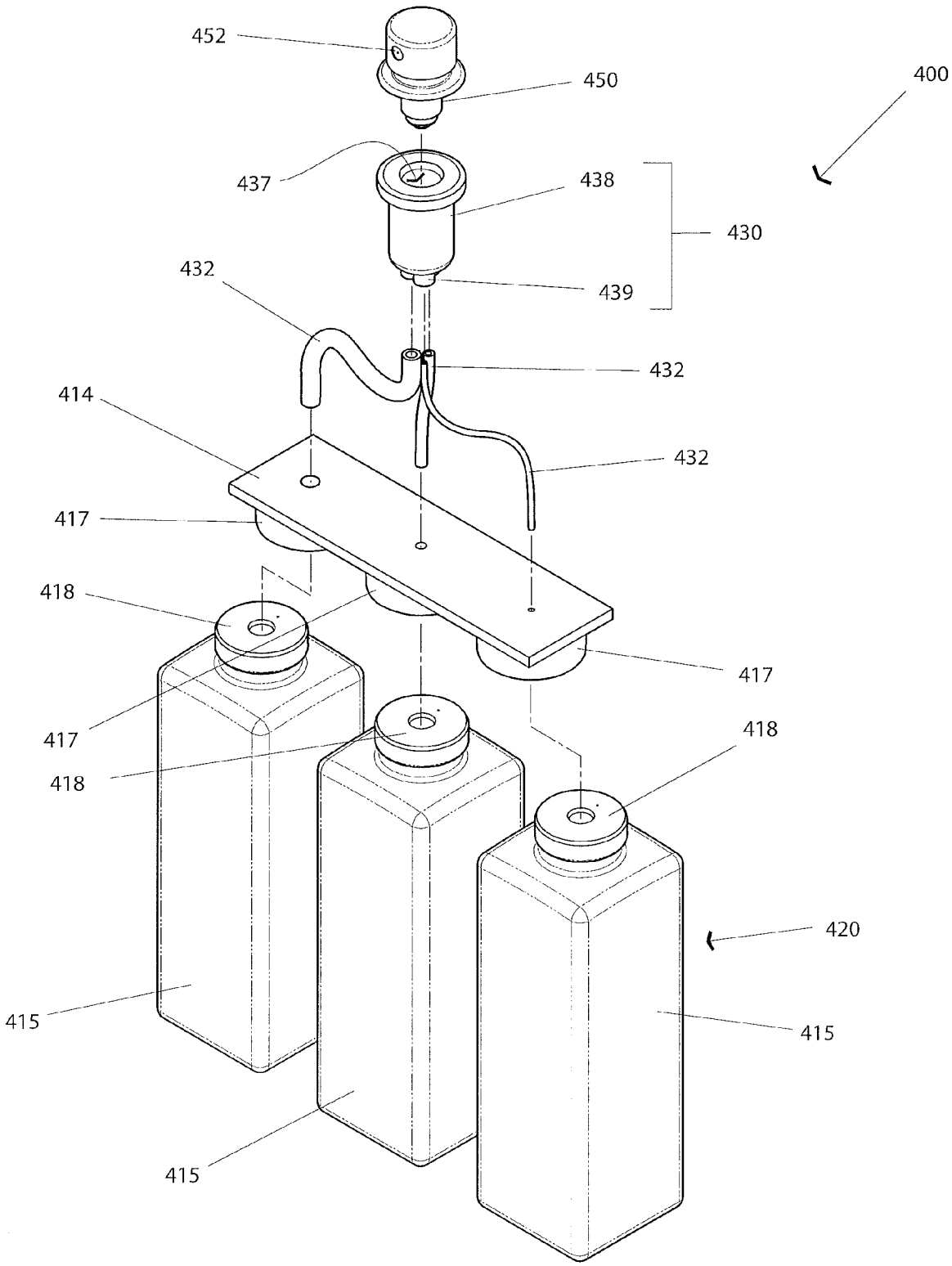

The flow of fluids through the device 300 is illustrated in FIG. 3A. During operation of the device, fluid is drawn by the dispensing pump 350 into the mixing chamber 337 through an inlet 339 and from the cartridge 315 of the corresponding cartridge assembly 320 to mix the selected volume of fluids to form the mixture and to expel the mixture from the nozzle 352 as described in connection with the device 100, and particularly FIG. 7. In another embodiment of the device 400 illustrated in FIG. 4, the device 400 has at least two cartridge assemblies 420 each comprising a cartridge 415. The cartridges 415 and cartridge assemblies 420 are the same as the cartridges 115 and the cartridge assemblies 120, respectively, described in connection with the device 100.

The cartridge assemblies 420 are positioned linearly, non-linearly, or radially relative to each other, as described in connection with the cartridge assemblies 120 of device 100. As illustrated in FIG. 4, each cartridge assembly 420 includes a conduit 419, a closure device 418, port (not shown), vent (not shown), optional bladder (not shown) as described in connection with the closure device 118, the port 116, the vent 113 of the device 100, respectively.

The device 400 also includes at least two flow channels 432, a manifold assembly 430, a dispensing pump 450, and a nozzle 452. The cartridge assemblies 420, the flow channels 432, the manifold assembly 430, and the pump 450 are enclosed in a body 412. The body 412 is as described in connection with the body 112.

As illustrated in FIG. 4, the device 400 has at least two flow channels 432 each configured to communicate with the interior of a corresponding cartridge 415 and that transports the fluid from the cartridge 415 to the mixing chamber 437 of the manifold 430 when the device 400 is in operation. Each flow channel 432 has proximal and distal ends, a central axis, and a lumen that has a diameter that is proportional to a mass flow rate of fluid that is drawn by the pump 450 from the corresponding cartridge 415 through the flow channel 432 each time the pump 450 is activated. As shown in FIG. 4, the proximal end of the flow channel 432 is in communication with one of the inlets 439 of the manifold 430. Optionally, the flow channel 432 is compressible or pliable, such as an elastomeric material, as described in connection with the flow channel 132.

Optionally, the device 400 includes an adjustable valve (not shown) as described in connection with the adjustable valve 140 that is positioned adjacent to the flow channel 432 to additionally adjust the mass flow rate of fluid that is drawn from the corresponding cartridge 415. In the device 400, however, the adjustable valves 140 are not required because the diameter of the lumen of each flow channel 132 provides the variable mass flow rate of fluid from each cartridge 432 during operation of the device 400.

As illustrated in FIG. 4, the mixing and dispensing device 400 has a manifold assembly 430 positioned downstream to the cartridge assembly 420. The manifold assembly 430 is the same as the manifold assembly 130 described in connection with the device 100. The manifold assembly 430 comprises a manifold body 430 that has at least one side wall and a base that define a mixing chamber 437. There is a plurality of inlets 439 on any surface of the manifold body 438. Manifold assembly 430 is the same as the manifold assembly 130 illustrated in FIG. 5 and has a seal 135 disposed within the mixing chamber 137 adjacent to the inlets 139 and a spring 134 disposed within the mixing chamber 137. As described in FIG. 7, the spring 134 is moveable between a compressed position and an extended position. A piston 133 is disposed within the mixing chamber 137 between the seal 135 and the spring 134.

Each inlet 439 is configured to communicate with a flow channel 432 of a corresponding cartridge assembly 420.

As illustrated in FIG. 4, the mixing and dispensing device 400 also has a dispensing pump assembly 450 positioned downstream to the manifold assembly 430. The dispensing pump assembly 450 is configured to communicate with a downstream nozzle 452. The dispensing pump assembly 450 and the nozzle 452 are as described in connection with dispensing pump assembly 150 and the nozzle 152, respectively, of the device 100. The flow of fluids through the device 400 is illustrated in FIG. 4A. During operation of the device 400, fluid is drawn by the dispensing pump 450 into the mixing chamber 437 through an inlet 439 and from the corresponding cartridge 415 to mix the fluids to formulate a mixture and to expel the mixture from the nozzle 152 as described in connection with the device 100, and particularly FIG. 7.

Figure 12:
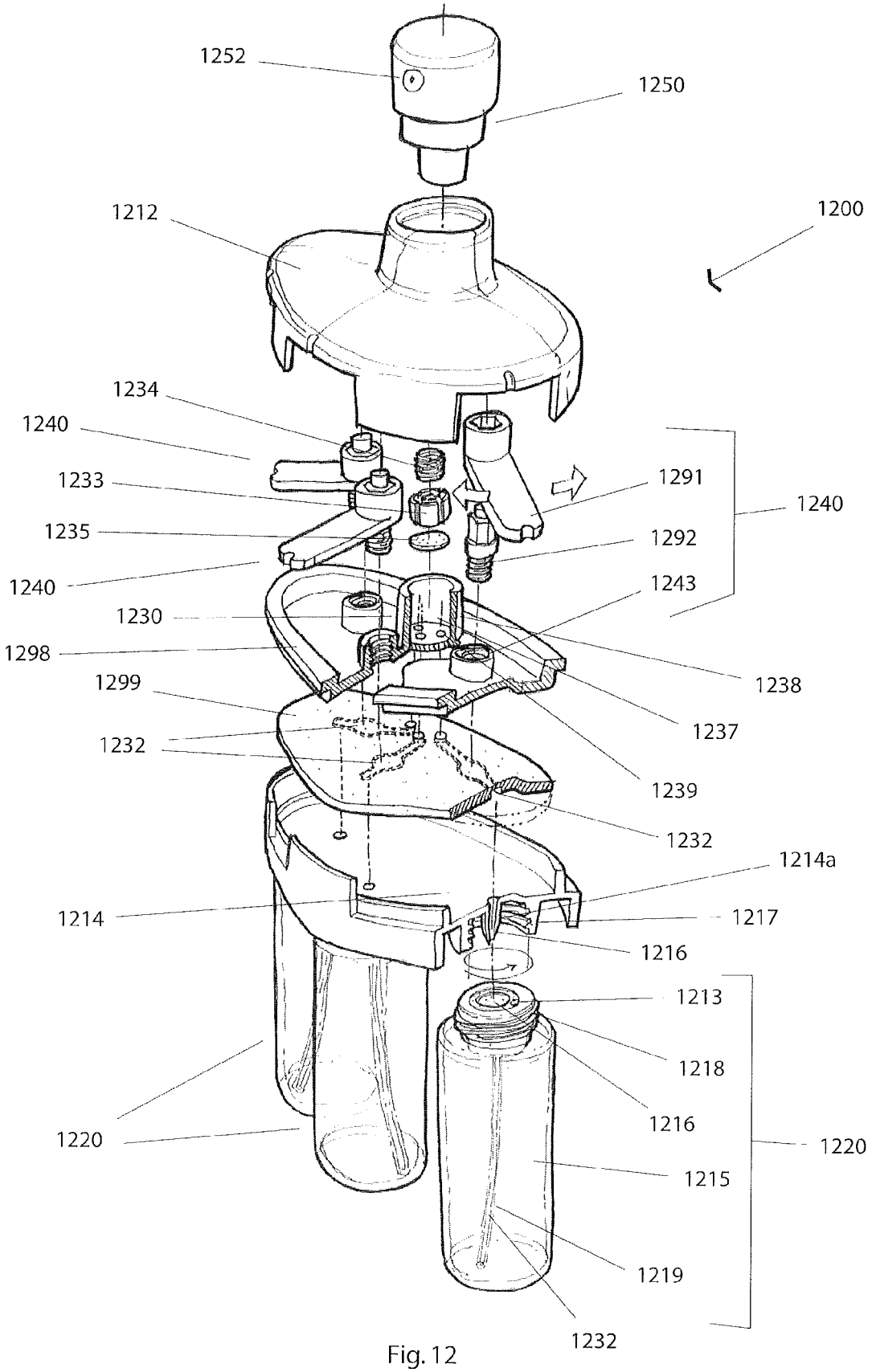
FIG. 12 is an exploded view of another embodiment of the mixing and dispensing device illustrating the cartridge and valve assemblies in a non-linear array.

In another embodiment of the device illustrated in FIG. 12, the device 1200 has at least two cartridge assemblies 1220 each comprising a cartridge 1215. The cartridges 1215 are the same as cartridges 115 described in connection with device 100. As illustrated in FIG. 12, the cartridge assemblies 1220 are positioned non-linearly relative to each other, but the cartridge assemblies 1220 may alternatively be positioned linearly or radially relative to each other as described in connection with the cartridge assemblies of the device 100. The cartridge assemblies 1220, the manifold assembly 1230, and the pump 1250 are enclosed in a body 1212. The body 1212 is as described in connection with the body 112 of the device 100.

As illustrated in FIG. 12, each cartridge 1220 has a closure device (not shown), port (not shown), vent 413, optional bladder (not shown) as described in connection with the closure device 118, the port 116, and the vent 113, respectively.

A spike plate 1214 is positioned downstream from the cartridge assemblies 1220 and has at least two cannulated spikes **1214*a*. Each spike 1214*a* has a proximal end that is configured to communicate with an interior of a corresponding cartridge 1215 and a distal end that is configured to communicate with one of flow channels 1232. Each flow channel 1232 is integrally formed or molded into a compressible, such as elastomeric, silicone, or thermo-plastic elastomer (TPE) layer 1299 that is positioned and sealed between the spike plate 1214 and a second plate 1298. The proximal end of the flow channel 1232 communicates with a corresponding inlet 1239 of the manifold 1230 via a port or other such opening in the second plate 1298**.

The device 1200 has at least two adjustable valves 1240 each positioned to communicate with a corresponding one of the flow channels 1232 and that adjusts mass flow rate of fluid that is drawn by the pump 1250 from the corresponding cartridge 1215 through the flow channel 1232 each time the pump 1250 rebounds. The adjustable valves 1240 are the same as the adjustable valves 140 described in connection with the device 100. In the embodiment shown in FIG. 12, the adjustable valve 1240 is a paddle-actuated valve. The valve 1240 has paddles 1291 that protrude through openings in the body 1212 to turn a threaded shaft 1292 that compresses layer 1299 thereby compressing the corresponding flow channel 1232 to reduce the mass flow rate of fluid through the flow channel 1232. The paddle 1291 is rotated in an opposite direction to turn the threaded shaft 1292 to decompress the layer 1299 to decompress the corresponding flow channel 1232 to rebound the mass flow rate of fluid through the flow channel 1232.

As illustrated in FIG. 12, the mixing and dispensing device 1200 has a manifold assembly 1230 positioned downstream to the adjustable valve 1240. The manifold assembly 1230 is the same as the manifold assembly 130 described in connection with the device 100. The manifold assembly 1230 comprises a manifold body 1238 that has at least one side wall and a base that define a mixing chamber 1237. There is a plurality of inlets 1239 on any surface of the manifold body 1238. As illustrated in FIG. 12, the manifold assembly 1230 also has a seal 1235 disposed within the mixing chamber 1237 adjacent the inlets 1239 and a spring 1234 disposed within the mixing chamber 1237. The spring 1234 is moveable between a compressed and an extended position as described in connection with FIG. 7. A piston 1233 is disposed within the mixing chamber 1237 between the seal 1235 and the spring 1234. The seal 1235, the spring 1234, and the piston 1233 are as described in connection with the seal 135, the spring 134, and the piston 133, respectively. Each inlet 1239 is configured to communicate with a flow channel 1232 of a corresponding cartridge assembly 1220.

As illustrated in FIG. 12, the mixing and dispensing device 1200 also has a dispensing pump assembly 1250 positioned downstream to the manifold assembly 1230. The dispensing pump assembly 1250 is configured to communicate with a nozzle 1252 that is positioned downstream thereto. The dispensing pump assembly 1250 and the nozzle 1252 are as described in connection with the dispensing pump 150 and the nozzle 152, respectively. During operation of the device 1200, fluid is drawn by the dispensing pump 1250 into the mixing chamber 1237 through an inlet 1239 and from the cartridge 1215 of the corresponding cartridge assembly 1220 to mix the selected volume of fluids to form the mixture and to expel the mixture from the nozzle 1252 as described in connection with device 100, and particularly FIG. 7

While the foregoing has been set forth in considerable detail, it is to be understood that the drawings and detailed embodiments are presented for elucidation and not limitation. Design variations, especially in matters of shape, size and arrangements of parts may be made but are within the principles described herein. Those skilled in the art will realize that such changes or modifications of the invention or combinations of elements, variations, equivalents or improvements therein are still within the scope of the mixing and dispensing device as defined in the appended claims.

We claim:

1. A device for mixing a plurality of fluids to formulate a mixture and for dispensing the mixture, the device comprising:

a plurality of cartridge assemblies each comprising a cartridge configured to contain one of the plurality of fluids;

a plurality of flow channels each having a central axis and each configured to communicate with a corresponding one of the cartridges;

a plurality of valve assemblies each positioned to communicate with one of the flow channels to adjust a mass flow rate of the fluid drawn from the corresponding cartridge;

a manifold assembly, comprising:

a manifold body having a mixing chamber and a plurality of inlets each configured to communicate with a corresponding one of the flow channels through which the fluid from the cartridge of the corresponding cartridge assembly is drawn into the mixing chamber during operation of the device;

a seal disposed within the manifold body adjacent to and having a size and a shape that substantially covers the inlets;

a spring disposed within the manifold body; and a piston disposed within the manifold body between the seal and the spring, wherein the spring is moveable between an extended position in which the spring engages the piston to move the seal to a closed position that substantially and simultaneously closes the inlets from the flow channels and a compressed position that moves the seal away from the inlets to substantially and simultaneously open the inlets to the flow channels;

a dispensing pump assembly configured to communicate with the manifold assembly and configured to draw fluid from each of the cartridge assemblies; and a nozzle configured to communicate with the dispensing pump assembly and to dispense the mixture;

wherein during operation the dispensing pump draws a volume of fluid from each cartridge through the corresponding flow channel and through the corresponding inlet into the mixing chamber to form the mixture, and wherein during operation the mixture is drawn from the mixing chamber through the dispensing pump to the nozzle.

2. The device as in claim 1, wherein each cartridge assembly further comprises:

a closure device configured to substantially close the cartridge;

a conduit positioned within the cartridge;

a port positioned within the closure device and having an opened and a closed position and configured to communicate with the conduit and the corresponding flow channel in the opened position; and a vent that is configured for entry of atmospheric air into the cartridge as fluid is removed when the dispensing pump is in a rebound state.

3. The device as in claim 1, further comprising a body encloses the cartridge assemblies, flow channels, valves, manifold assembly, and dispensing pump assembly.

4. The device as in claim 1, wherein a portion of the body is configured to open and close to provide access to the cartridge assemblies.

5. The device as in claim 1, wherein the cartridge assembly further comprises a bladder positioned in an interior of the cartridge and configured to hold the fluid.

6. The device as in claim 1, wherein the plurality of inlets is positioned in a base of the manifold body.

7. The device as in claim 1, wherein an outer surface of a side wall of the piston has at least one channel that extends substantially parallel to a central axis of the mixing chamber.

8. The device as in claim 1, wherein the adjustable valve is adjustable along a second axis that is not parallel to the central axis of the corresponding flow channel at a point along the flow channel at which the adjustable valve is adjacent and is configured to constrict a lumen of the flow channel to decrease the mass flow of fluid.

9. The device as in claim 8, wherein the adjustable valve comprises:

a control;

a threaded shaft that has a tip and that is mated to the control knob; and a clamp into which the point along the flow channel is positioned;

wherein an axial rotation of the control in a first direction progressively moves the threaded shaft towards the clamp to a closed position that constricts the lumen of the flow channel; and wherein an axial rotation of the control in a second direction progressively moves the threaded shaft away from the clamp to an opened position that rebounds the lumen of the flow channel.

10. The device as in claim 8, wherein the adjustable valve comprises:

a control;

a roller that is mated to the control;

a ramp that has an axis that is positioned at an angle relative to an axis of linear movement of the roller;

wherein the point along the flow channel is positioned between the roller and the clamp;

wherein a movement of the control in a first direction progressively moves the roller along the ramp to a closed position that constricts the lumen of the flow channel; and wherein a movement of the control in a second direction progressively moves the roller along the ramp to an opened position that rebounds the lumen of the flow channel.

11. The device as in claim 1, wherein the adjustable valve is positioned within a lumen of the flow channel.

12. The device as in claim 11, wherein the adjustable valve comprises:

a control;

a needle having a tip and positioned within a valve body;

wherein the needle is mated to the control;

wherein an axial rotation of the control in a first direction axially advances the needle within the lumen of the flow channel;

wherein an axial rotation of the control in a second direction axially withdraws the needle within the lumen of the flow channel.

13. A device for mixing a plurality of fluids to form a mixture and for dispensing said mixture, comprising:

a plurality of cartridges each configured to contain one of the plurality of fluids;

a plurality of flow channels each having a central axis and each configured to communicate with a corresponding one of the cartridges;

a plurality of independently adjustable valves each positioned adjacent to one of the flow channels and adjustable along a second axis that is not parallel to the central axis to adjust a mass flow rate of the fluid drawn from the corresponding cartridge;

a manifold body having a plurality of inlets each configured to communicate with a corresponding one of the flow channels through which the fluid from the corresponding cartridge is drawn into a mixing chamber during operation;

a seal disposed within the manifold body adjacent to and sized to substantially cover the inlets;

a piston disposed within the manifold body between the seal and a spring, wherein the spring is moveable between an extended position in which the spring engages the piston to move the seal to a closed position that substantially and simultaneously closes the inlets from the flow channels and a compressed position that moves the seal away from the inlets to substantially and simultaneously open the inlets to the flow channels;

a dispensing pump configured for communication with the mixing chamber and configured to draw fluid from each of the cartridges; and a nozzle configured for communication with the dispensing pump and configured to dispense the mixture, wherein during operation the dispensing pump draws a volume of fluid from each cartridge through the corresponding flow channel and through the corresponding inlet into the mixing chamber to form the mixture, and wherein during operation the mixture is drawn from the mixing chamber through the dispensing pump to the nozzle.

14. The device of claim 13, wherein each cartridge is removable.

15. The device of claim 13, further comprising at least two closure device each configured to substantially close a corresponding one of the cartridges.

16. The device of claim 13, further comprising:

a spike plate positioned downstream to the cartridges;

a second plate positioned downstream to the spike plate; and a compressible layer positioned between the spike plate and second plate and into which flow channels are formed.

17. The device of claim 13, wherein an outer surface of a side wall of the piston has at least one channel that extends substantially parallel to a central axis of the mixing chamber.

18. The device of claim 13, wherein the closure device is positioned in an upstream portion of cartridges.

19. The device of claim 13, further comprising a spike plate positioned upstream to the cartridge and having at least two cannulated spikes configured to communicate with an interior of the cartridge and at least two uptube ports configured to communicate with the flow channels.

20. A device for mixing a plurality of fluids to form a mixture and for dispensing the mixture, comprising:

a plurality of cartridge assemblies, each cartridge assembly comprising cartridge configured to contain one of the plurality of fluids;

a plurality of flow channels each having a lumen having a diameter, a central axis, and each configured o communicate with a corresponding one of the cartridges, wherein the diameter of each flow channel is directly proportional to a mass flow rate of fluid drawn from the corresponding cartridge during operation of the device;

a manifold assembly, comprising:

a manifold body having a mixing chamber and a plurality of inlets each configured to communicate with a corresponding flow channel through which the fluid from the cartridge of the corresponding cartridge assembly is drawn into the mixing chamber during operation;

a seal disposed within the manifold body adjacent to and sized to substantially and simultaneously close the inlets;

a spring disposed within the manifold body; and a piston disposed within the manifold body between the seal and the spring, wherein the spring is moveable between an extended position in which the spring engages the piston to move the seal to a closed position that substantially and simultaneously closes the inlets from the flow channels and a compressed position that moves the seal away from the inlets to substantially and simultaneously open the inlets to the flow channels;

a dispensing pump assembly configured for communication with the manifold assembly and configured to draw fluid from each of the cartridge assemblies; and a nozzle configured for communication with the dispensing pump assembly and configured to dispense the mixture, wherein during operation the dispensing pump draws the volume of fluid from each cartridge assembly through the corresponding inlet into the mixing chamber to form the mixture, and wherein during operation the mixture is drawn from the mixing chamber through the dispensing pump to the nozzle.

21. The device of claim 20, wherein the diameter of each flow channel is different from the diameter of the other flow channels.

22. The device of claim 20, further comprising a plurality of independently adjustable valves each positioned to communicate with a corresponding one of the flow channels to adjust the mass flow rate of fluid drawn from the corresponding cartridge.

23. The device of claim 20, wherein an outer surface of a side wall of the piston has at least one channel that extends substantially parallel to a central axis of the mixing chamber.

* * * * *